US012798870B2

(12) United States Patent
Chiu et al.

(10) Patent No.: US 12,798,870 B2
(45) Date of Patent: Nov. 17, 2026

(54) HOLDING DEVICE FOR TOP-OPENING SUBSTRATE CONTAINER

(71) Applicant: GUDENG PRECISION INDUSTRIAL CO., LTD., New Taipei City (TW)

(72) Inventors: Ming-Chien Chiu, New Taipei City (TW); Yung-Chin Pan, New Taipei City (TW); Cheng-En Chung, New Taipei City (TW); Wei-Chien Liu, New Taipei City (TW); Tzu-Ning Huang, New Taipei City (TW); Tzu-Chi Chao, New Taipei City (TW); Tzu-Wei Huang, New Taipei City (TW); Chia-Liang Liu, New Taipei City (TW)

(73) Assignee: GUDENG PRECISION INDUSTRIAL CO., LTD., New Taipei City (TW)

( * ) Notice: Subject to any disclaimer, the term of this patent is extended or adjusted under 35 U.S.C. 154(b) by 49 days.

(21) Appl. No.: 18/525,887

(22) Filed: Dec. 1, 2023

(65) Prior Publication Data

US 2025/0019144 A1 Jan. 16, 2025

Related U.S. Application Data

(60) Provisional application No. 63/512,665, filed on Jul. 10, 2023.

(51) Int. Cl.
*B65D 85/38* (2006.01)
*B65D 81/05* (2006.01)

(52) U.S. Cl.
CPC ..... *B65D 85/38* (2013.01); *B65D 81/053* (2013.01); *B65D 2581/051* (2013.01); *B65D 2585/86* (2013.01)

(58) Field of Classification Search
CPC ..... B65D 85/38; B65D 81/053; B65D 2581/051; B65D 2585/86; B65D 85/48;
(Continued)

(56) References Cited

U.S. PATENT DOCUMENTS 5,957,292 A * 9/1999 Mikkelsen ..... H10P 72/1914 414/217
2011/0100870 A1* 5/2011 Ohnuki ..... H10P 72/1918 248/346.03

FOREIGN PATENT DOCUMENTS

CN 103165499 * 6/2013
WO WO-2006035894 A1 * 4/2006 ..... G03F 1/66

* cited by examiner

*Primary Examiner* — Rafael A Ortiz

(57) ABSTRACT

A holding device for a top-opening substrate container includes a holding assembly for pushing a substrate actuator disposed at a substrate to operate. The holding assembly includes a holding body and a pushing actuator. The pushing actuator includes a first guiding sloped surface for pressing against a second guiding sloped surface of an inner surface of a container door structure. The first guiding sloped surface causing corresponding pushing and displacement between the first guiding sloped surface and the second guiding sloped surface according to a supporting force of the container door structure. A pushing section is connected to the first guiding sloped surface, and capable of correspondingly pushing the substrate actuator to operate according to a level of the pushing and displacement of the first guiding sloped surface, such that the substrate actuator displaces substrates and stacks the substrates with another in layers.

16 Claims, 22 Drawing Sheets

(58) Field of Classification Search
CPC ..... B65D 81/05; B65D 25/10; B65D 81/07; B65D 81/30; H01L 21/67; H10P 72/1912; H10P 72/1918; H10P 72/1914; H10P 72/1922
USPC ..... 206/701, 710–712
See application file for complete search history.

10

HOLDING DEVICE FOR TOP-OPENING SUBSTRATE CONTAINER

CROSS-REFERENCE TO RELATED APPLICATION

This non-provisional application claims priority under 35 U.S.C. § 119(e) on U.S. provisional Patent Application No. 63/512,665 filed on Jul. 10, 2023, the entire contents of which are hereby incorporated by reference.

BACKGROUND OF THE INVENTION

1. Field of the Invention

The present disclosure provides a holding device for a substrate container, and in particular to a holding device for a top-opening substrate container capable of securely holding and preventing damage to substrates carried in the top-opening substrate container as well as variably adjusting the number of substrates that can be carried.

2. Description of the Related Art

Sheet-like products of related electronic devices in industry, for example, sheet-like semiconductor workpieces such as circuit boards, wafers, and glass, often need to be accommodated in containers for protection, storing, and transportation. Containers that carry these sheet-like semiconductor workpieces of electronic device-related products or semiconductor process-related members need well-designed substrate container protection measures and holding devices, so as to prevent damage of the semiconductor workpieces stored and carried therein.

Common factors that damage substrates of substrate workpieces include, for example, wear, scratches, and particle or dust contamination caused by vibration or friction, or substrate collision or breakage caused by wavering, hopping, or falling off of the substrates due to an insecure container or insecure internal structures of a container. Hence, quality and yield rate of substrates during processes of storage, carrying, and transportation are degraded, and damage to substrates of semiconductor workpiece products occur. Therefore, the industry needs a solution capable of securely holding multiple layers of substrates, so as to prevent issues of vibration, collision, displacement, or friction between substrates.

Moreover, carrying space design specifications for current substrate containers define that only a certain number of substrates can be stacked, and are rather monofunctional in one single size. New molds need to be additionally manufactured for substrate containers in response to different numbers of substrates needing to be carried, leading to high costs and poor utilization efficiency on top of lacking a function of securely holding substrates.

In addition, for substrates with a large size or a large weight carried in a conventional substrate container such that the overall weight is relatively heavy, a door for covering the substrate container can easily descend due to a concentrated weight because of the center of gravity, causing deformation of the door and undesirably affecting airtightness. Therefore, there is a need for a solution for solving such challenging issues of maintaining airtightness under a condition of a substrate container carrying a relatively large weight.

BRIEF SUMMARY OF THE INVENTION

In view of the above, a holding device for a top-opening substrate container provided by the present disclosure achieves multiple functions including securely pressing against and securing multiple layers of substrates, maintaining airtightness, and having a sharable container in response to different numbers of substrates needing to be carried, and provides a solution for preventing issues of vibration, displacement, or friction between substrates.

A holding device for a top-opening substrate container is provided according to an embodiment of the present disclosure. The top-opening substrate container includes a container body and a container door structure, wherein the container door structure is configured to be combined with the container body so as to define a receiving space for accommodating multiple substrates. The hold device includes: a substrate actuator, disposed at an outer side part of the substrate; and a holding assembly, disposed in the receiving space, the holding assembly for pushing against the substrate actuator to operate. The holding assembly includes: a holding body, disposed at an inner side part of the container body; and a pushing actuator, disposed at the holding body. The pushing actuator includes: a first guiding sloped surface, for pressing against a second guiding sloped surface of an inner surface of the container door structure, the first guiding sloped surface causing corresponding pushing and displacement between the first guiding sloped surface and the second guiding sloped surface according to a pressing force of the container door structure; and a pushing section connected to the first guiding sloped surface, the pushing section corresponding to a position of the substrate actuator, the pushing section correspondingly pushing the substrate actuator to operate according to a level of the pushing and displacement of the first guiding sloped surface, such that the substrate actuator displaces a substrate until multiple substrates are stacked and positioned with each other.

In one embodiment, the holding body includes an inclined guide channel, and the pushing actuator includes a guiding section connected to the pushing section. The guiding section protrudes in the inclined guide channel, and displaces correspondingly in the inclined guide channel according to the pressing force of the container door structure, such that the pushing actuator comes close to the holding body or gets away from the holding body.

In an embodiment, the holding assembly further includes an elastic element disposed between the holding body and the pushing actuator. The elastic element is configured to provide, according to the pressing force of the container door structure, an elastic variation for the guiding section to displace in a direction away from the holding body along the inclined guide channel, or for the guiding section to displace in a direction close to the holding body along the inclined guide channel.

In one embodiment, the substrate actuator includes: a connection section, fixedly connected to the outer side part of the substrate; an elastic deformation section, connected to the connection section, the elastic deformation section corresponding to a position of the pushing section, the elastic deformation providing a displacement amount for elastic deformation and pushing the substrate according to a level of pushing and displacement of the pushing section; and a first fixed section, disposed at one lateral part of the elastic deformation section, the first fixed section for fixing a second fixed section of the adjacent substrate.

In an embodiment, a bottom of the inner surface of the container body further includes a bottom positioning component, the substrate includes a substrate position member corresponding to the bottom positioning component, and the bottom positioning component is for positioning the substrate located closest to the bottom of the inner surface in the receiving space.

In one embodiment, a bottom of the inner surface of the container body further includes a bottom snap component for engaging and fixing between the substrate closest to the bottom of the inner surface in the receiving space and the substrate actuator disposed thereon.

In an embodiment, each of upper and lower surfaces of each substrate is provided with an adapted stacked fixed section, and the adjacent substrates are stacked in layers with one another by the stacking fixed sections.

In an embodiment, the holding device further includes at least one elastic support element disposed at a bottom section of the substrate and for elastically pressing against a semiconductor workpiece on a carried substrate.

In one embodiment, the elastic support element includes a fixed end and an elastic support arm. The fixed end is detachably disposed at the bottom section of the substrate, one end of the elastic support arm is connected to the fixed end, and the other end of the elastic support arm elastically presses against an edge surface of the semiconductor workpiece.

In one embodiment, an inner wall of the container body is provided with an anti-misalignment component for restricting a direction of the substrates accommodated in the receiving space.

A holding device for a top-opening substrate container is provided according to an embodiment of the present disclosure. The top-opening substrate container includes a container body and a container door structure, wherein the container body is configured to be combined with the container body so as to define an accommodation body for accommodating multiple substrates. The hold device includes: a frame body, disposed in the receiving space, for carrying the substrates; multiple quick release components, individually disposed at an outer side part of the frame body, each quick release component including and resting element and opposing shoulder, the opposing shoulder connected to both sides of the resting element, wherein multiple fastening components are further provided on the inner wall of the container body, the resting element is abutted against the inner wall, and the fastening component is fastened at the shoulder so as to fix the frame body; and multiple displacement sections, providing a yield space for a holding assembly disposed in the receiving space.

In an embodiment, when the resting element receives a force and leaves the inner wall by a distance, the opposing shoulder departs from the fastening component such that the frame body becomes a detachable state.

In one embodiment, a bottom of an inner surface of the container body further includes a bottom positioning component, the frame body includes a frame positioning component corresponding to the bottom positioning component, and the bottom positioning component is for positioning the frame positioning component, so as to define a height distance between the frame body and the bottom of the inner surface of the container body, wherein the bottom positioning component and the fastening component are at a same horizontal height.

In an embodiment, an inner wall of the container body is provided with an anti-misalignment component for restricting a direction of the frame body accommodated in the receiving space.

A hold device for a top-opening substrate container is provided according to an embodiment of the present disclosure. The top-opening container includes a container body and a container door structure, wherein the container door structure is configured to be combined with the container body, and the container body has a receiving space for accommodating a latch mechanism. The hold device includes: at least one leveling component, disposed in the receiving space, the leveling component globally extending and pressing against two opposite inner walls of the container body, wherein the leveling component and the latch mechanism are arranged in parallel.

In an embodiment, the leveling component is a carbon rod, of which an overall height is less than a total depth of the receiving space.

In the holding devices for a top-opening substrate container of the present disclosure, with the pushing actuator and the inclined guide channel provided, the pushing actuator is provided with a pressing force while the container body is closed at the container body, so that the pushing actuator operates and displaces along a direction of the inclined guide channel to further enable the pushing section of the pushing actuator to displace in a direction of the substrate so as to press against the substrate actuator and fix the substrates, thereby achieving the object of securely fixing the carried substrates.

DETAILED DESCRIPTION OF THE INVENTION

The technical contents of the present disclosure are to be further described in detail by way of embodiments with the accompanying drawings. It should be noted that, in the present disclosure, terms such as "first", "second" and "third" are used to distinguish differences among elements, and are not to be construed as limiting to the elements themselves or specific orders of the elements. Moreover, in the present disclosure, a specific number is specified, the article "a/an/one" refers to one element or more.

To fully understand the objects, features, and effects of the present disclosure, the present disclosure is described in detail by way of specific embodiments with the accompanying drawings.

Figure 1:
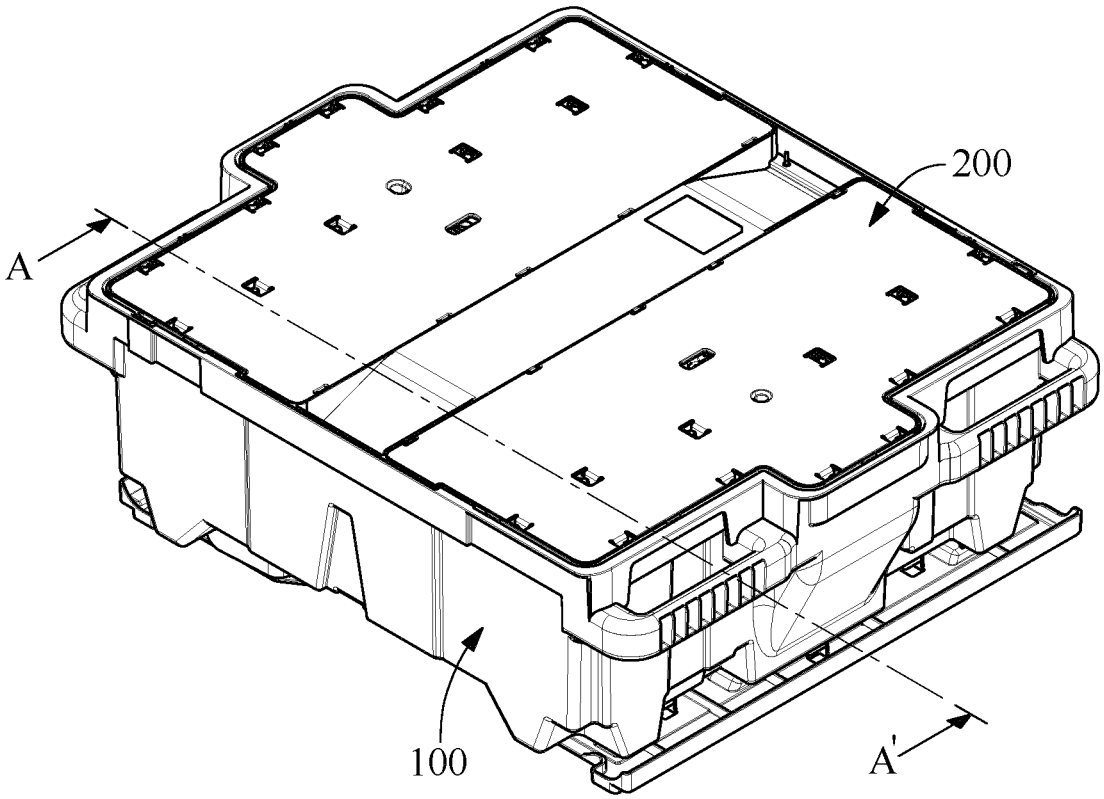
FIG. 1 is a perspective schematic diagram of a top-opening substrate container according to an embodiment of the present disclosure.
Figure 2A:
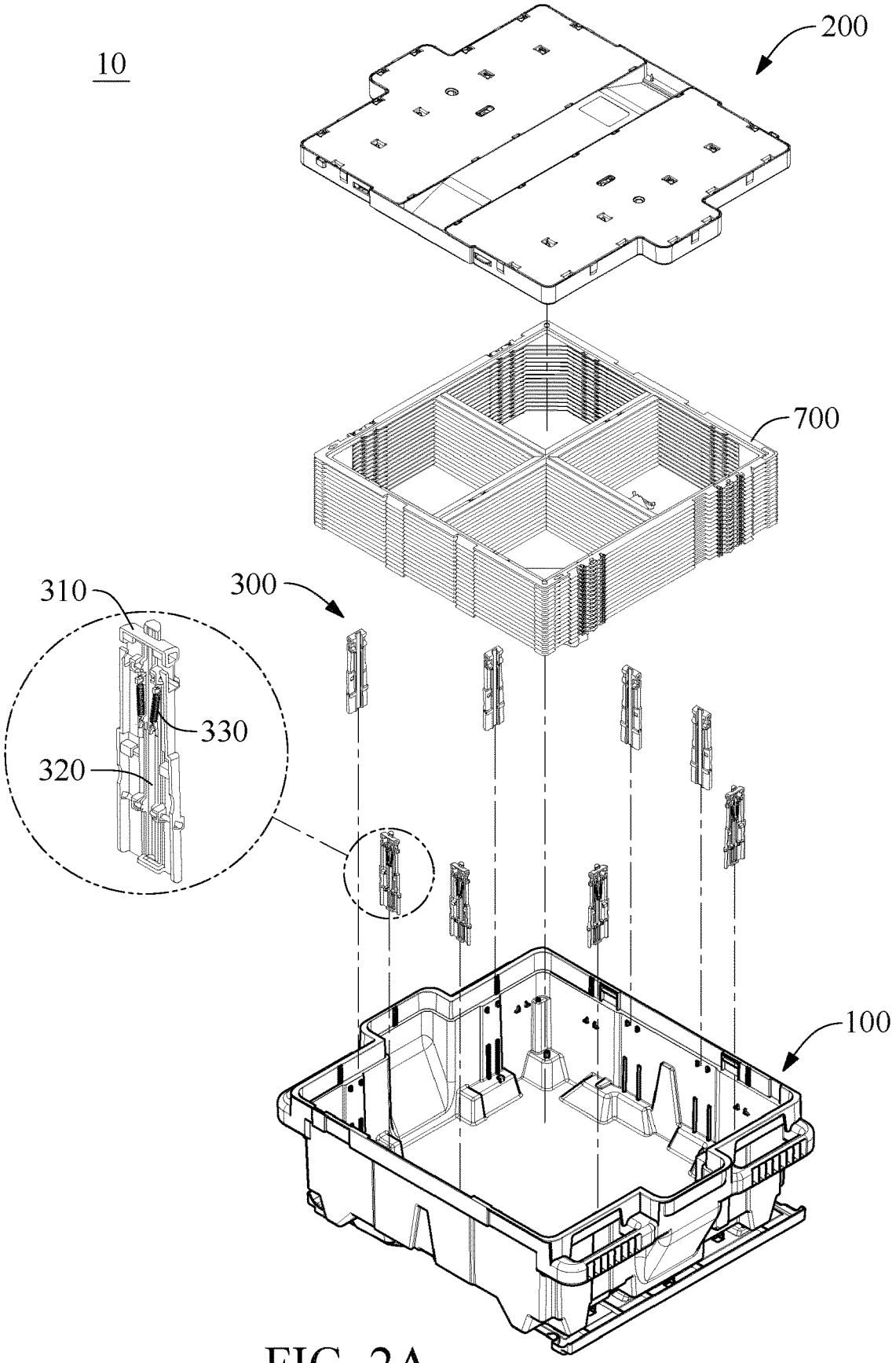
FIG. 2A is an exploded schematic diagram of a top-opening substrate container according to an embodiment of the present disclosure.
Figure 2B:
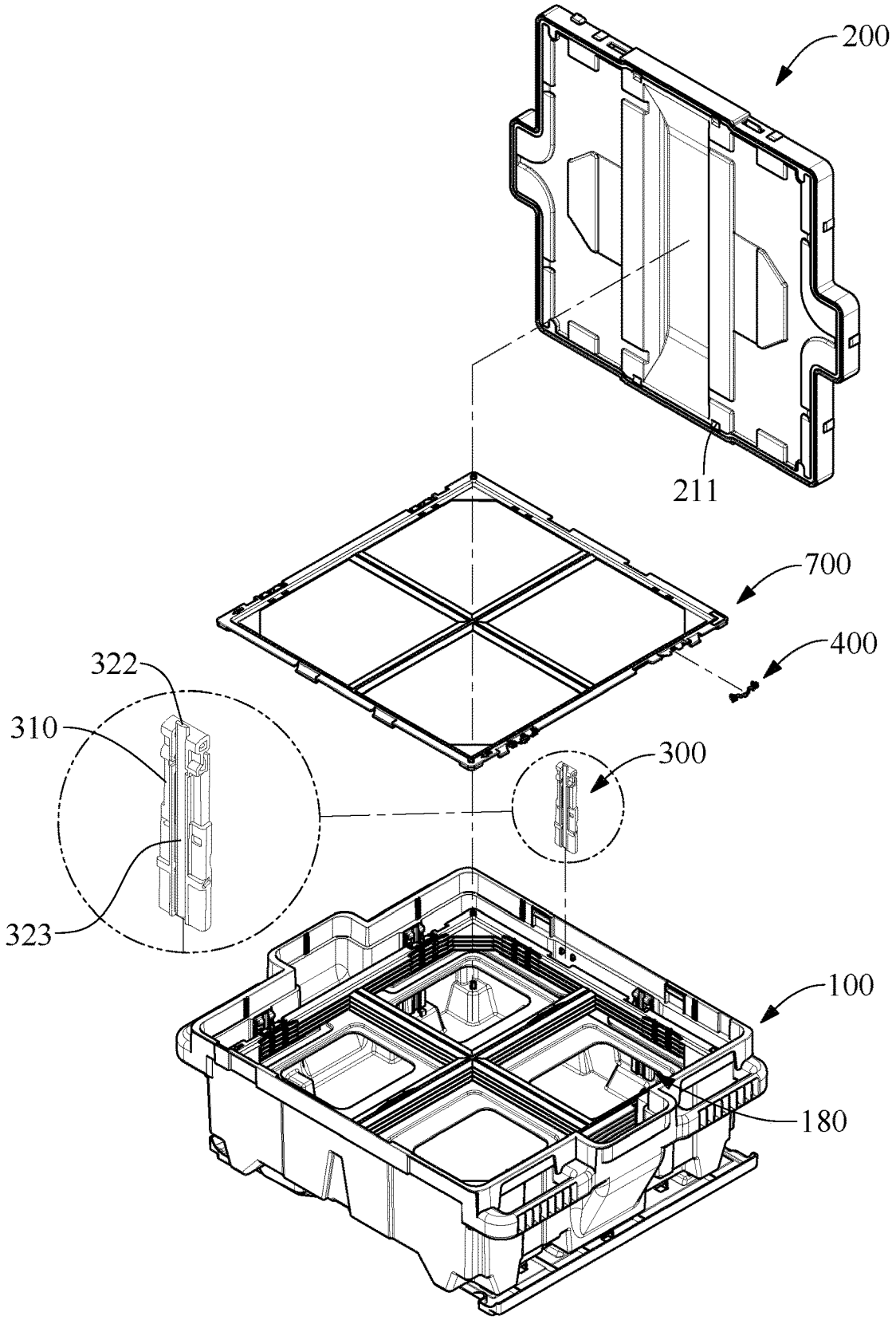
FIG. 2B is another exploded schematic diagram of a top-opening substrate container according to an embodiment of the present disclosure.

FIG. 1 shows a perspective schematic diagram of a top-opening substrate container according to an embodiment of the present disclosure. FIG. 2A shows an exploded schematic diagram of a top-opening substrate container according to an embodiment of the present disclosure. FIG. 2B shows another exploded schematic diagram of a top-opening substrate container according to an embodiment of the present disclosure. It should be noted that the angles of the elements are adjust for better description.

Referring to FIG. 1, FIG. 2A, and FIG. 2B, a holding device for a top-opening substrate container according to an embodiment of the present disclosure is adapted for a top-opening substrate container 10, and includes a container body 100 and a container door structure 200. The container door structure 200 is adapted to be combined with the container body 100 so as to define a receiving space 180. The receiving space 180 of the container body 100 is for accommodating a plurality of substrates 700, which can be trays for carrying semiconductor workpieces (for example, wafers or printed circuit boards (PCB)). The container body 100 is also adapted to accommodate sheet-like substrates in various forms, and adapted to store and carry sheet-like products related to industrial electronic elements including, for example but not limited to, circuit boards, wafers, substrates, and pieces of glass. In an embodiment of the present disclosure, the container door structure 200 is located at an upper opening of the container body 100, and is for sealing the upper opening of the container body 100. An internal space sandwiched and formed by the container door structure 200 and the container body 100 is the receiving space 180 which can be used to accommodate and stack a plurality of sheet-like substrates 700.

As shown in FIG. 2A and FIG. 2B, the container body 100 of the top-opening substrate container 10 can accommodate the substrates 700 therein. In an embodiment, each substrate 700 is a tray, for example. The substrates 700 are for carrying and holding sheet-like semiconductor workpieces, each of which can be separately carried by one substrate 700. The number of the substrates 700 can be one or multiple. The plurality of substrates 700 can be aligned and stacked with one another, so that the carried semiconductor workpieces are kept at a distance from one another and are held and stored in the top-opening substrate container 10. It should be noted that, the shape of the substrate 700 shown in the drawings is merely an example, and a device in any shape for carrying semiconductor workpieces can serve as a variation form of the substrate 700.

As shown in FIG. 2A and FIG. 2B, the holding device is adapted for the top-opening substrate container 10. The holding device includes a holding assembly 300 disposed at the container body 100, and a substrate actuator 400. The substrate actuator 400 is disposed at an outer side part of the substrate 700. The holding assembly 300 is disposed in the receiving space 180 and is for pushing the substrate actuator 400 to operate so as to hold the substrate 700. The holding assembly 300 includes a holding body 310 and a pushing actuator 320. The holding body 310 is disposed at an inner side part of the container body 100. The pushing actuator 320 is disposed at the holding body 310, and includes a first guiding sloped surface 322 and a pushing section 323. The first guiding sloped surface 322 is for pressing against a second guiding sloped surface 211 of an inner surface 210 of the container door structure 200, as shown in FIG. 3C. The first guiding sloped surface 322 causes corresponding pushing and displacement between the first guiding sloped surface 322 and the second guiding sloped surface 211 according to a supporting force of the container door structure 200. The pushing section 323 is connected to the first guiding sloped surface 322, corresponds to the position of the substrate actuator 400, and correspondingly pushes the substrate actuator 400 to operate according to a level of the pushing and displacement of the first guiding sloped surface 322, such that the substrate actuator 400 displaces the substrate 700 until the plurality of substrates 700 are stacked and positioned with one another. In an embodiment of the present disclosure, the holding assembly 300 further includes an elastic element 330, which is to be described later.

In an embodiment of the present disclosure, the holding assembly 300 is multiple in number, for example, eight. These holding assemblies 300 are individually disposed around the container body 100 and face one side of the receiving space 180, so as to securely clamp edges of the substrates 700, and to ensure that the substrates 700 do not vibrate, waver, or collide against one another. The number of the holding assembly 300 can be adjusted according to requirements, and is not specifically defined herein.

Figure 3A:
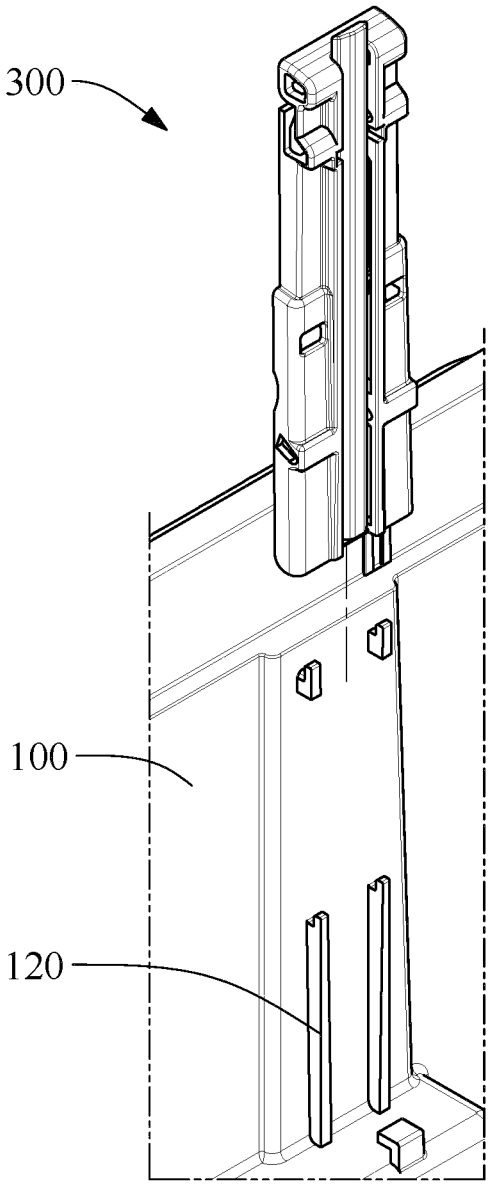
FIG. 3A is a schematic diagram of an installation means of a holding assembly according to an embodiment of the present disclosure.
Figure 3B:
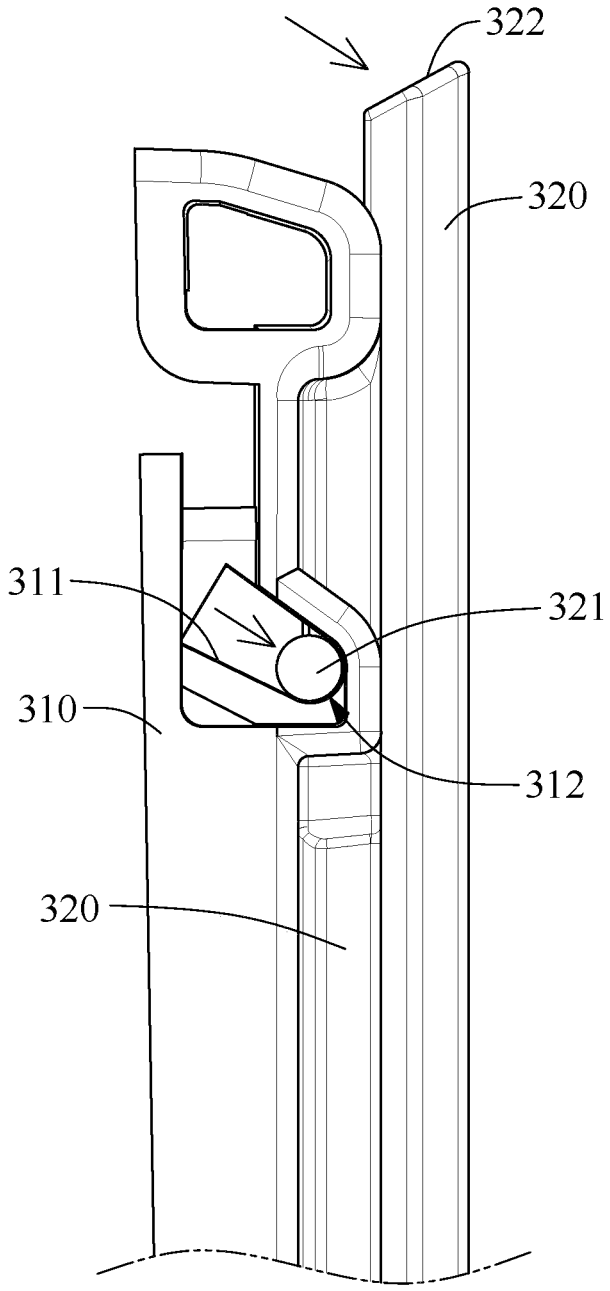
FIG. 3B is a side schematic diagram of a holding assembly according to an embodiment of the present disclosure.
Figure 3C:
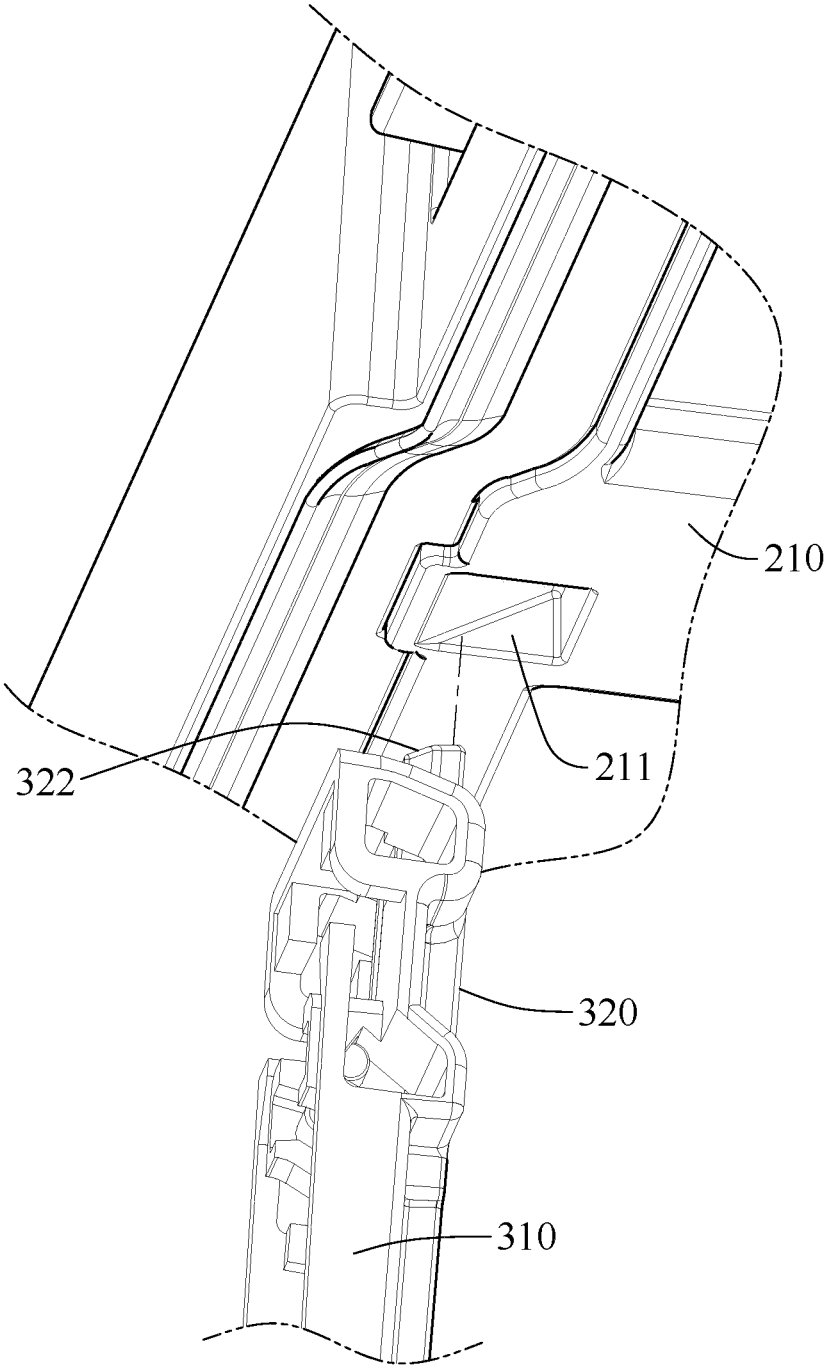
FIG. 3C is a perspective schematic diagram of a container door structure and a holding assembly according to an embodiment of the present disclosure.

Refer to FIG. 3A to FIG. 3C. FIG. 3A shows a schematic diagram of an installation means of the holding assembly 300 according to an embodiment of the present disclosure. FIG. 3B shows a side schematic diagram of the holding assembly 300 according to an embodiment of the present disclosure. FIG. 3C shows a perspective schematic diagram of a container door structure and a holding assembly according to an embodiment of the present disclosure.

The holding assembly 300 is disposed at an inner mounting section 120 of the container body 100 facing an inner side part where the substrates 700 are accommodated. The inner mounting section 120 can be, for example, a recessed groove or a fastening groove, and has a fit fastening structure so as to be fastened with the holding body 310 of the holding assembly 300, thereby securely fixing the holding assembly 300 and enabling the holding assembly 300 to be elastically detachable and adjustable.

Operation details of the holding assembly 300 are first described herein. The holding body 310 includes an inclined guide channel 311, and the pushing actuator 320 includes a guiding section 321 connected to the pushing section 323. The guiding section 321 protrudes in the inclined guide channel 311, such that the guiding section 321 can only displace along an axis of the inclined guide channel 311. Also referring to FIG. 4C, the elastic element 330 is disposed between the holding body 310 and the pushing actuator 320. Meanwhile, with the guiding section 321 protruding in the inclined guide channel 311, the pushing actuator 320 can be installed at the holding body 310 without falling off. During the process of the container door structure 200 closing relative to the container body 100, an inner surface 210 of the container door structure 200 faces the pushing actuator 320, such that the second guiding sloped surface 211 presses against the first guiding sloped surface 322 of the pushing actuator 320, and the first guiding sloped surface 322 causes corresponding pushing and displacement between the first guiding sloped surface 322 and the second guiding sloped surface 211 according to the supporting force of the container door structure 200. Meanwhile, the pushing section 323 connected to the first guiding sloped surface 322 correspondingly operates according to a push distance of the first guiding sloped surface 322. The first guiding sloped surface 322 only has an end point in contact with the second guiding sloped surface 211. Thus, in addition to increasing the concentration of a force application point, a contact area can be reduced, so as to prevent the issue of generation of dust.

More specifically, the pushing section 323 corresponds to the position of the substrate actuator 400. The pushing section 323 causes the guiding section 321 to displace along the axis in the inclined guide channel 311 according to the level of pushing and displacement of the first guiding sloped surface 322, until the guiding section 321 is limited at an enclosed end 312 of the inclined guide channel 311, as shown by a direction of the arrow in FIG. 3B, so that the pushing actuator 320 gets away from the holding body 310. The elastic element 330 is configured to provide, according to the supporting force of the container door structure 200, an elastic variation (elastic stretching) for the guiding section 321 to displace in a direction away from the holding body 310 along the inclined guide channel 311. In other words, the guiding section 321 of the pushing actuator 320 performs a downward guided displacement by a distance at the inclined guide channel 311 of the holding body 310, such that the elastic element 330 is gradually stretched and the pushing actuator 320 gets slightly away from the holding body 310. At this point, the pushing actuator 320 moves toward a direction of the substrate actuator 400 clamping the substrate 700.

Conversely, during a process of the container door structure 200 opening relative to the container body 100, the elastic element 330 provides, according to the supporting force of the container door structure 200, an elastic variation (elastic reset) for the guiding section 321 to move away from the enclosed end 312 along the inclined guide channel 311 and to displace in a direction close to the holding body 310. In other words, when the container door structure 200 is removed, the elastic element 330 releases elastic potential, and the guiding section 321 of the pushing actuator 320 performs an upward guided displacement by distance at the inclined guide channel 311 of the holding body 310, such that the pushing actuator 320 comes close to the holding body 310 and becomes away from the substrate actuator 400 to exhibit a state of pressing against the substrate actuator 400. Meanwhile, as the force applied on the substrate actuator 400 is released, deformation of the elastic deformation section 420 is also released to thereby release interference between a first fixed section 410 and a second fixed section 720, so that the stacked substrates 700 are no longer fixed with one another. Moreover, the first fixed section 410 of the substrate actuator 400 installed at the bottom most substrate 700 likewise no longer interferes with a bottom snap component 110 at a bottom of the container body 100, thereby facilitating a machine, a robotic arm, or a manual means to freely take out the plurality of substrates 700 one after another or as a whole.

Thus, with the elastic lock and release mechanism on the substrates 700, the top-opening substrate container 10 having the holding device of the present disclosure is provided with numerous advantages including being easy to operate, intuitive, and error-proof. By merely covering the container door structure 200, operating staff or an automated machine can carry out secure and effective locking and securing on the substrates 700 without involving additional operation procedures. Moreover, a non-interfering state of the substrates 700 can be naturally restored by merely removing the container door structure 200.

The elastic element 330 is, for example, disposed at the other side of the pushing actuator 320 relative to the holding body 310, and one end of the elastic element 300 is fixed at the holding body 310 and the other is fixed at the pushing actuator 320.

A sloped surface normal vector of the first guiding sloped surface 322 is parallel to a slope surface normal vector of the second guiding sloped surface 211, that is, having a same sloped surface angle. An angle and a size of the second guiding sloped surface 211 are adapted to the first guiding sloped surface 322. A sloped surface length of the first guiding sloped surface 322 is equal to a displacement distance of the inclined guide channel 311. Thus, with the second guiding sloped surface 211 provided on the container door structure 200, when the container door structure 200 vertically abuts against the pushing actuator 320, it is ensured that the first guiding sloped surface 322 is able to partially displace synchronously while the pushing actuator 320 displaces along the inclined guide channel 311, thereby guaranteeing that the pushing actuator 320 provides a stable downward force of action.

The first guiding sloped surface 322 of the pushing actuator 320 and the second guiding sloped surface 211 of the container door structure 200 can be in other structural forms, and structures that are capable of matchingly sliding with other and coming into contact with each other by a smaller contact area are to be encompassed within the scope of protection of the present disclosure.

Figure 4A:
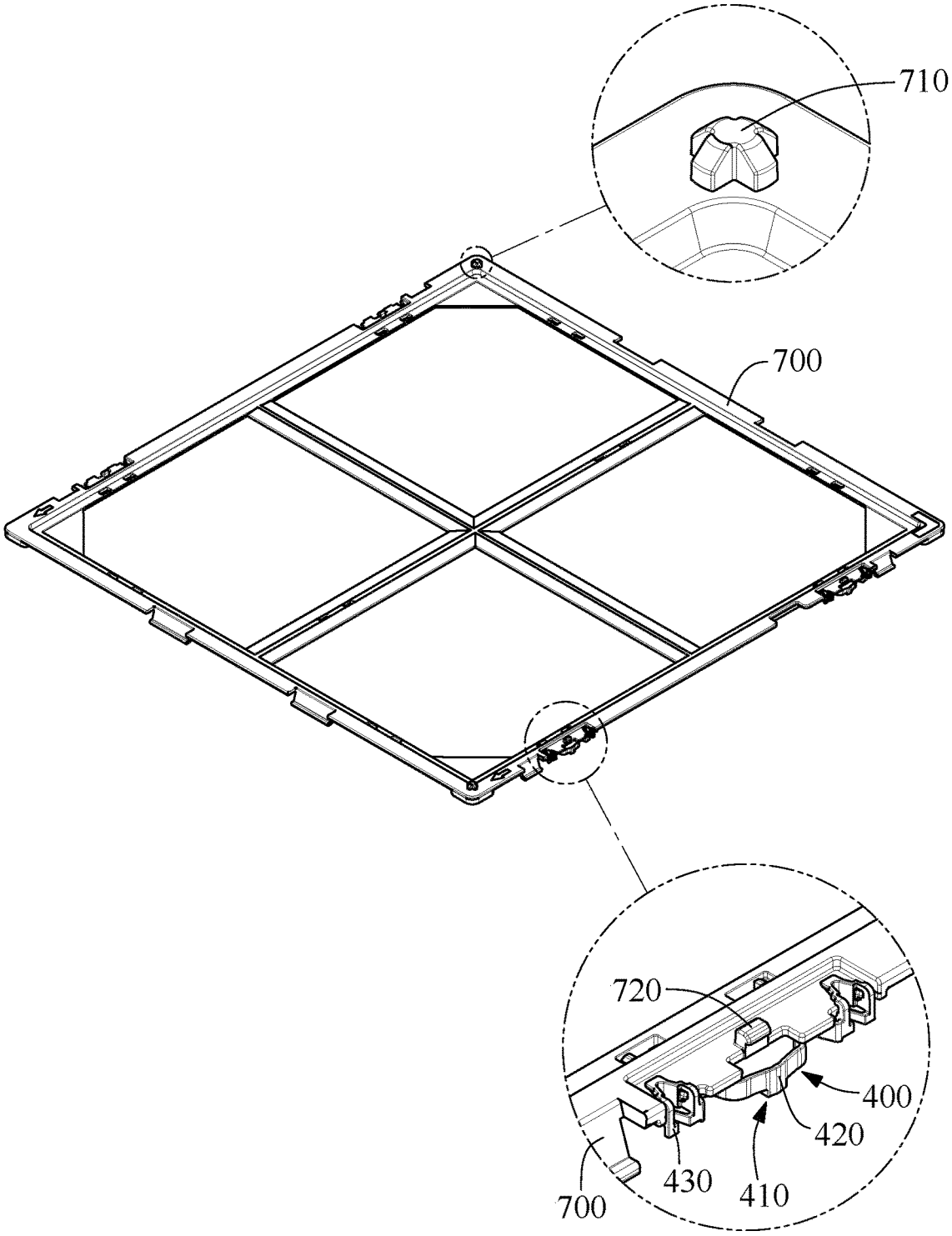
FIG. 4A is a perspective schematic diagram of a substrate and a substrate actuator according to an embodiment of the present disclosure.
Figure 4B:
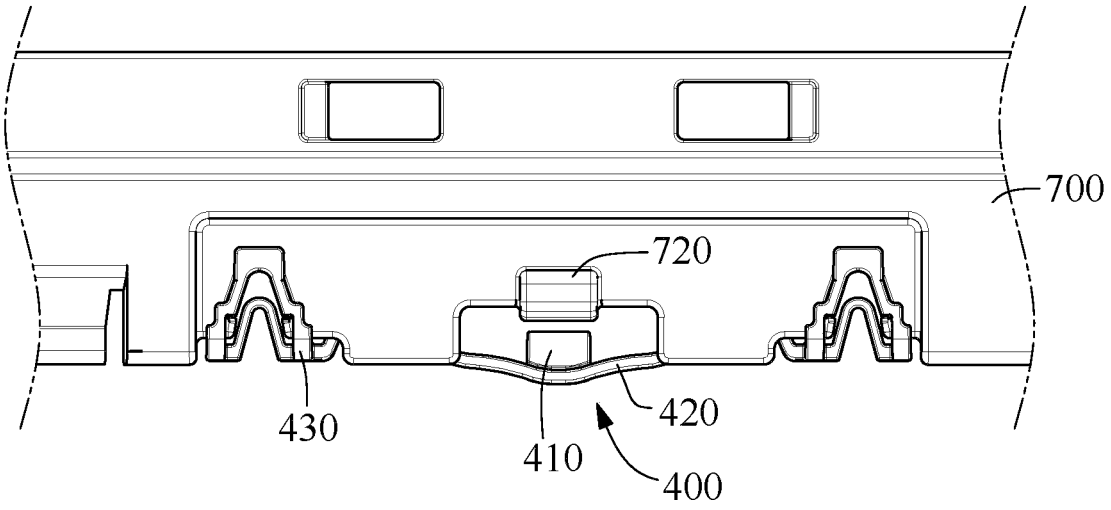
FIG. 4B is an enlarged partial plan schematic diagram of a substrate and a substrate actuator according to an embodiment of the present disclosure.
Figure 4C:
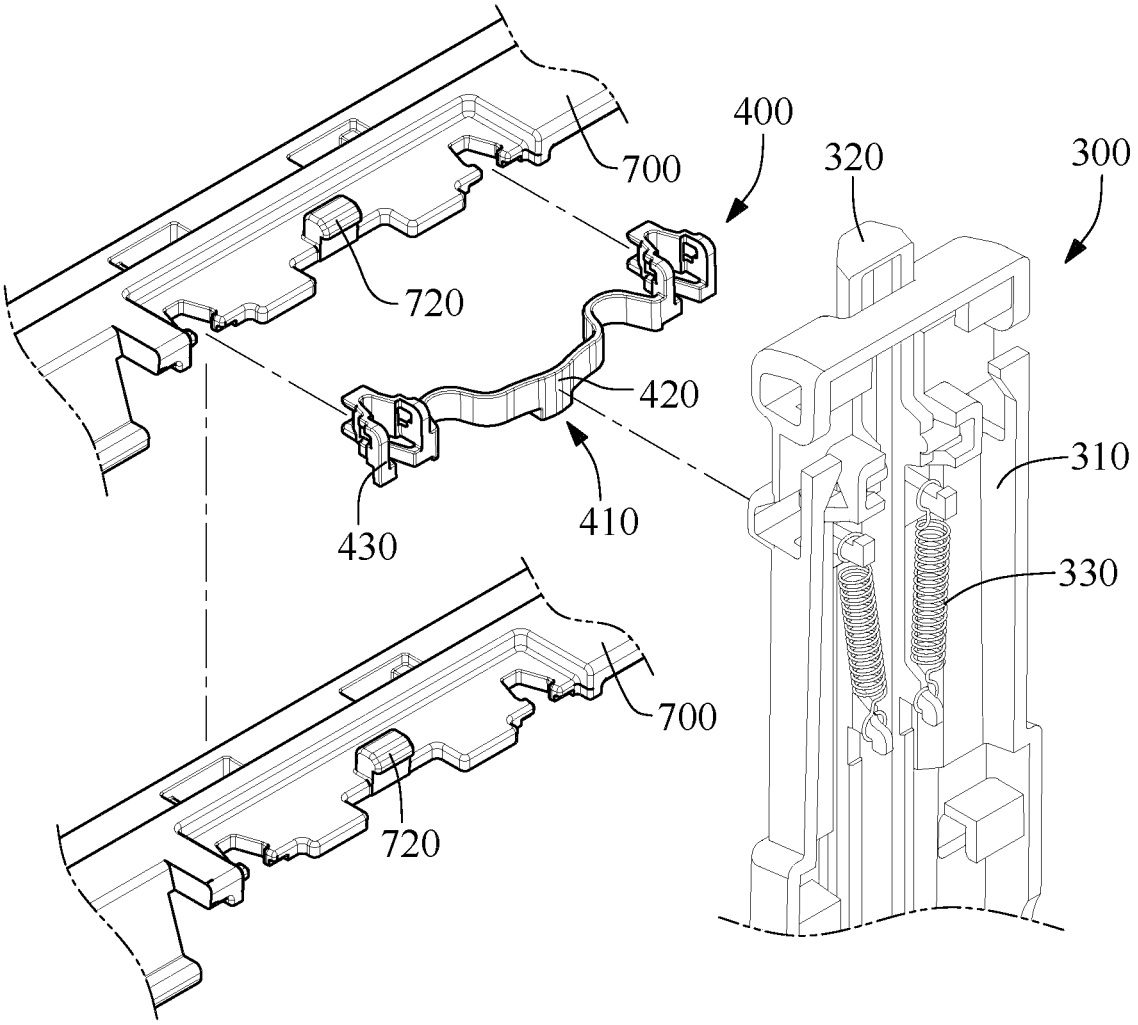
FIG. 4C is an exploded schematic diagram of a substrate, a substrate actuator and a holding assembly according to an embodiment of the present disclosure.
Figure 4D:
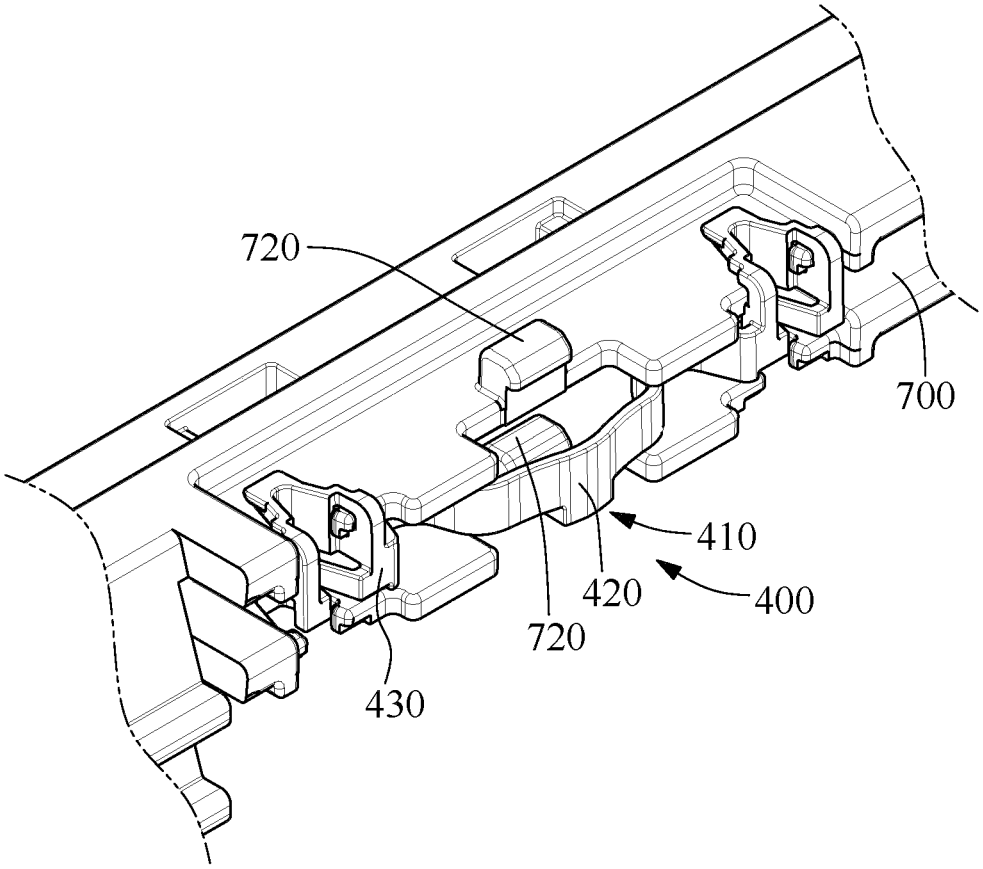
FIG. 4D is a schematic diagram of an elastic deformation section of a substrate actuator before deformation according to an embodiment of the present disclosure.
Figure 4F:
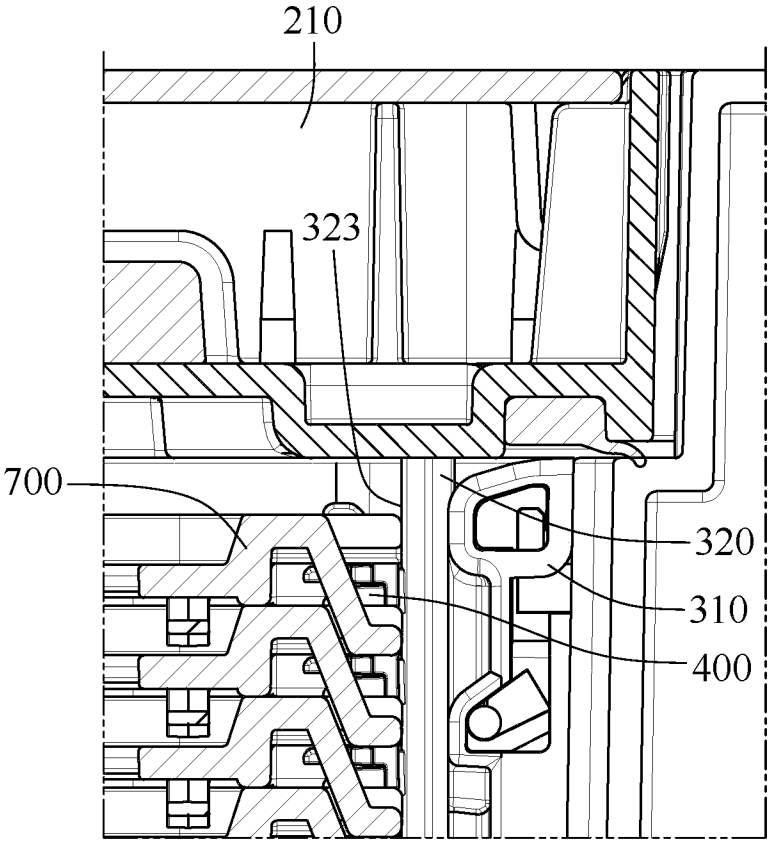
FIG. 4F is a schematic diagram of a holding assembly after pushing according to an embodiment of the present disclosure.
Figure 4E:
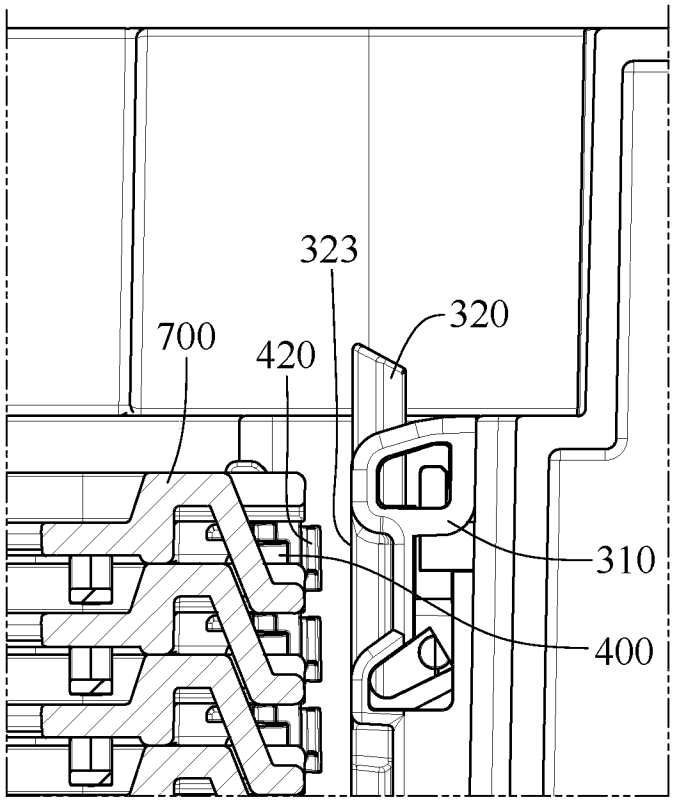
FIG. 4E is a schematic diagram of a holding assembly before pushing according to an embodiment of the present disclosure.

An operation relationship between the holding assembly 300 and the substrate actuator 400, as well as structural details of the substrate actuator 400 are to be described next. Refer to FIG. 4A to FIG. 4F. FIG. 4A shows a perspective schematic diagram of a substrate and a substrate actuator according to an embodiment of the present disclosure. FIG. 4B shows an enlarged partial plan schematic diagram of a substrate and a substrate actuator according to an embodiment of the present disclosure. FIG. 4C shows an exploded schematic diagram of a substrate, a substrate actuator, and a holding assembly according to an embodiment of the present disclosure. FIG. 4D shows a schematic diagram of an elastic deformation section of a substrate actuator before deformation according to an embodiment of the present disclosure. FIG. 4E shows a schematic diagram of a holding assembly before pushing according to an embodiment of the present disclosure. FIG. 4F shows a schematic diagram of a holding assembly after pushing according to an embodiment of the present disclosure. Moreover, FIG. 4E and FIG. 4F are section diagrams along the line A-A' in FIG. 1.

The substrate actuator 400 is adapted to serve as a buffer elastic element for buffering, clamping, and fixing between the pushing actuator 320 and the substrate 700. The substrate actuator 400 includes a connection section 430, an elastic deformation section 420 and a first fixed section 410. The connection section 430 is fixedly connected to an outer side part of the substrate 700, for example, an edge. The connection section 430 is located on both ends of the elastic deformation section 420, and is fixedly connected in a clamping manner to the outer side part of the substrate 700. The elastic deformation section 420 is connected to the connection section 420, and is configured to correspond to the position of the pushing section 323. The first fixed section 410 is disposed at one lateral part of the elastic deformation section 420, for example, a lower position, and is for fixing a second fixed section 720 of the adjacent substrate 700.

When the pushing actuator 320 receives the supporting force of the container door structure 200 and gets away from the holding body 310 to apply the supporting force in the direction of the elastic deformation section 420, the elastic deformation section 420 is caused to correspond to the position of the pushing section 323 and provides a displacement amount for elastic deformation and pushing the substrate 700 according to the level of pushing and displacement of the pushing section 323. In other words, the pushing section 323 of the pushing actuator 320 is abutted against the elastic deformation section 420, and the elastic deformation section 420 is linked with the first fixed section 410 to displace toward the second fixed section 720 of the adjacent substrate 720, until the container door structure 200 completes closing the container body 100, such that the elastic deformation section 420 receives a maximum supporting force and thus fixes the first fixed section 410 on the second fixed section 720 of the adjacent substrate 700. Since the receiving space 180 is for accommodating the plurality of substrates 700, with the coordinated operation between the holding assembly 300 and the substrate actuator 400, the first fixed sections 410 are allowed to sequentially be fastened with the adjacent substrates 700 one layer after another, hence achieving the effect of positioning the plurality of substrates 700 with one another in layers.

With the operation principles above, by applying a force by the pushing actuator 320 upon the elastic deformation section 420 of the substrate actuator 400, the plurality of substrates 700 stacked on one another can be provided with a positioning effect of the substrates 700 one layer after another through the mutual matching and connection of the first fixed section 410 and the second fixed section 720, and the push action of the pushing actuator 320 is stopped only when the container door structure 200 covers the container body 100. The substrate 700 located at the uppermost may not carry any semiconductor workpiece so as to reduce the risk of damage to the substrates.

With the elastic deformation section 420 that deforms elastically, the substrate actuator 400 is provided with good deformation elasticity and buffering effects. Thus, when the pushing actuator 320 is about to become abutting, the substrate actuator 400 can moderately and securely fix the substrate 700.

Thus, with the supporting of the pushing actuator 320 of the holding assembly 300, in addition to securely fixing the substrate 700 connected and fixed by the substrate actuator 400, the adjacent substrate 700 can also be pressed against and fixed at the same time, thereby achieving the effect of securely locking the plurality of substrates 700 stacked in layers. Moreover, as each substrate 700 includes the corresponding substrate actuator 400, the substrates 700 can be individually fastened, pressed against, and fixed one layer after another, hence achieving the effect of mutually securely clamping and fixing all the substrates 700 in the substrate container 10 without causing friction or collision of the substrates 700 due to wavering or vibration of the container body 100.

The elastic deformation section 420 is capable of achieving engagement and coupling between the first fixed section 410 and the second fixed section 720 without involving an overly large degree of deformation. Moreover, with the corresponding structural characteristics of the engagement and coupling, in addition to providing supporting and fixing in the horizontal direction, engaging and fixing in the vertical direction can be further provided to reinforce the supporting and fixing strength by the engaging structure itself.

Figure 5A:
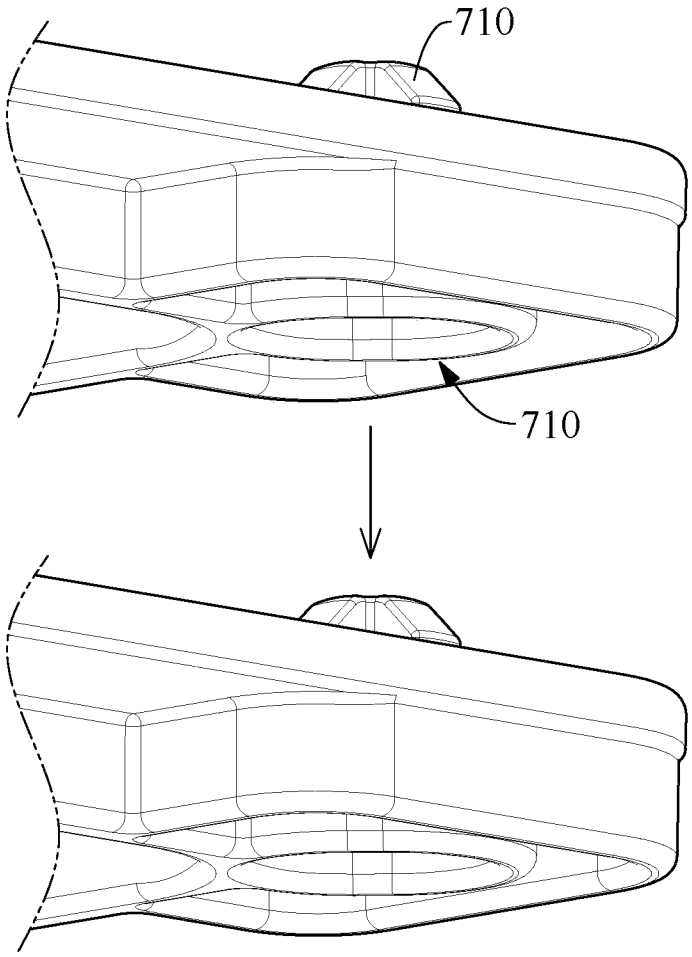
FIG. 5A is an enlarged partial perspective schematic diagram of a stacking fixed section of a substrate according to an embodiment of the present disclosure.
Figure 5B:
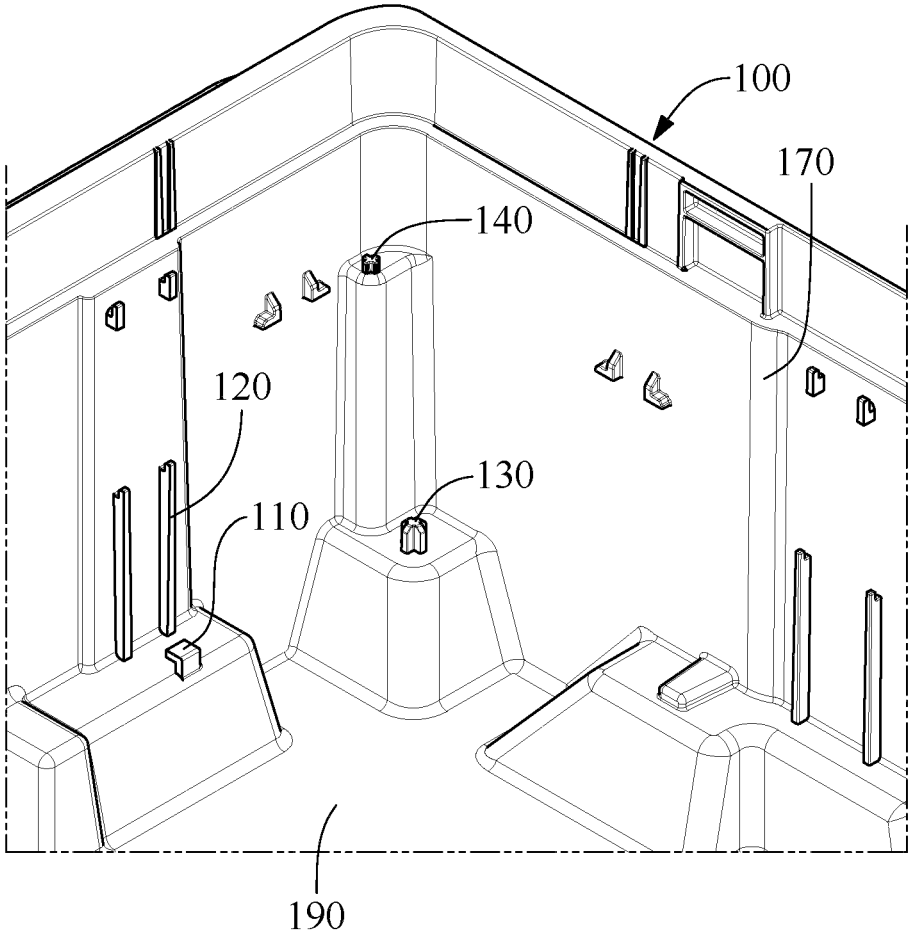
FIG. 5B is an enlarged partial perspective schematic diagram of a container body according to an embodiment of the present disclosure.
Figure 5C:
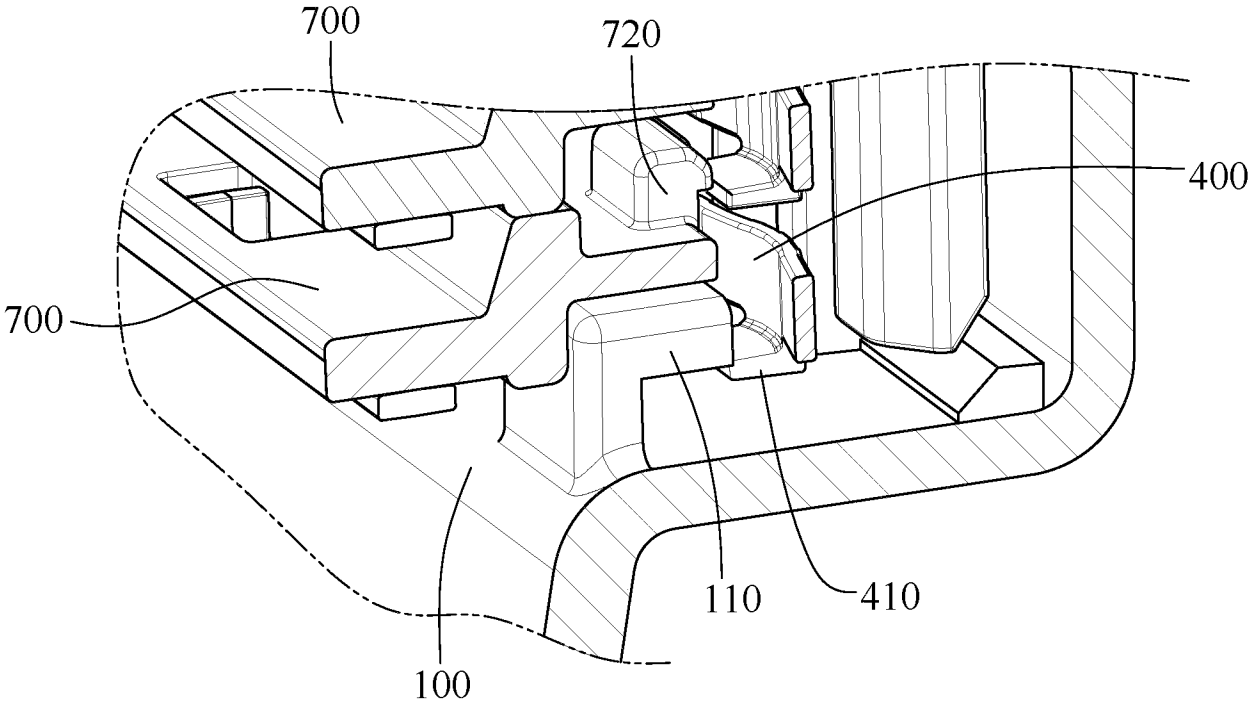
FIG. 5C is another enlarged partial perspective schematic diagram of a container body according to an embodiment of the present disclosure.

Refer to FIG. 5A to FIG. 5C. FIG. 5A shows an enlarged partial perspective schematic diagram of the stacking fixed section 710 of the substrate 700 according to an embodiment of the present disclosure. FIG. 5B shows an enlarged partial perspective schematic diagram of the container body 100 according to an embodiment of the present disclosure. FIG. 5C shows another enlarged partial perspective schematic diagram of the container body 100 according to an embodiment of the present disclosure.

A bottom 190 of the inner surface of the container body 100 further includes a bottom positioning component 130 for engaging and fixing between the substrate 700 closest to the bottom 190 of the inner surface in the receiving space 180 and the substrate actuator 400 disposed thereon. The bottom positioning component 130 is preferably disposed at an inner edge corner of the receiving space 180, so as to be secured and positioned at corners of the substrate 700. It should be noted arrangement positions and number of the bottom positioning component 130 are not specifically defined, and any arrangement positions and number adapted to the shape of the substrate 700 are to be encompassed within the scope of protection of the present disclosure. Each of the upper and lower surfaces of each substrate 700 is provided with an adapted stacked fixed section 710, and adjacent substrates 700 are stacked in layers with one another by the stacking fixed sections 710. The stacking fixed section 710 of the substrate 700 closest to the bottom 190 of the inner surface is at the same time adapted to the bottom positioning component 130, so that the stacking fixed section 710 can be aligned and fixed to correspond to the position of the bottom positioning component 130.

The container body 100 further includes a bottom snap component 110 below the inner mounting section 120 installed with the holding assembly 300. The bottom snap component 110 is for abutting against the first fixed section 410 of the substrate actuator 400 corresponding to the bottommost substrate 700, so as to securely hold the bottommost substrate 700. The bottom snap component 110 includes an inverted hook structure so as to be engaged and fixed with the first fixed section 410 corresponding to the bottommost substrate 700 and to reinforce fixation between the entire set of substrates 700 and the container body 100.

An inner wall of the container body 100 is provided with an anti-misalignment component 170 for limiting a direction of the substrate 700 accommodated in the receiving space 180. The anti-misalignment component 170 is, for example, a protruding column structure to correspond to a recessed structure of edges of the substrate 700, so that the substrate 700 can be placed in correct orientation into the container body 100.

The stacking fixed section 710 can be a protruding/recessed corresponding structure, thereby achieving the effects of positioning, alignment, and stacking. It should be noted that, the stacking fixed section 710 is not limited to being a protruding/recessed corresponding structure, and any other structure capable of being stacked for limiting can be easily conceivable based on the present disclosure, for example but not limited to, other types of structures or structures based on principles other than mechanics, such as magnetic attraction for stacking all the substrates 700 with one another, so that the plurality of substrates 700 are aligned and stacked vertically, and left and right wavering between the substrates 700 are reduced.

Figure 6A:
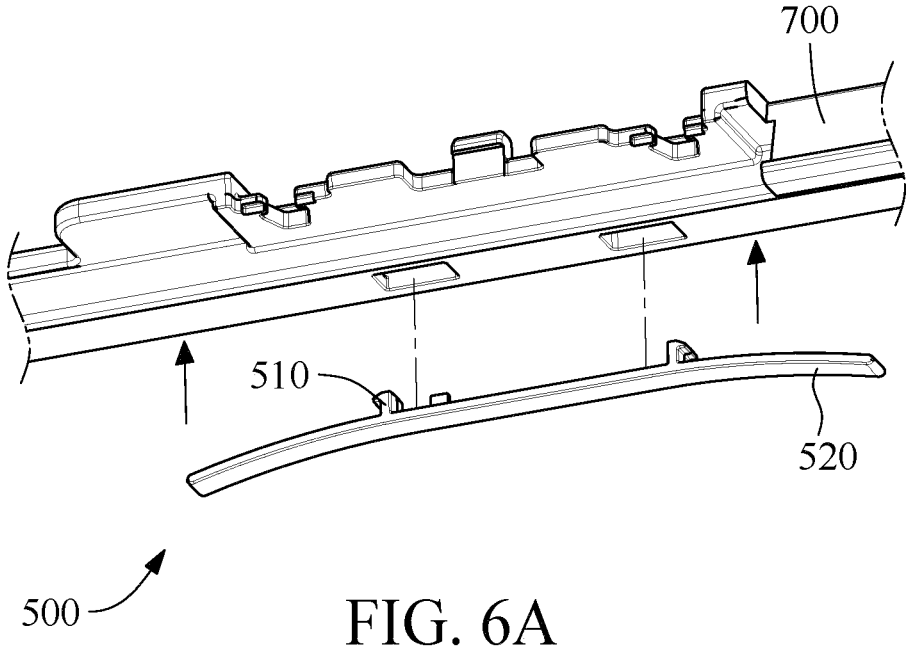
FIG. 6A is a schematic diagram of an assembly means of an elastic support element according to an embodiment of the present disclosure.
Figure 6B:
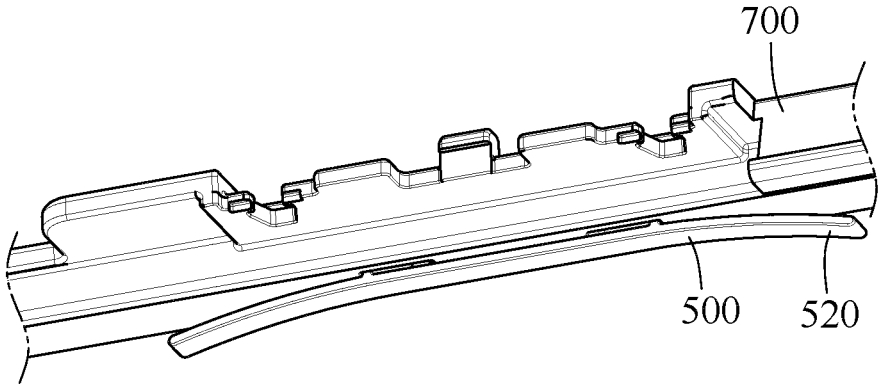
FIG. 6B is a perspective schematic diagram of an elastic support element according to an embodiment of the present disclosure.
Figure 6C:
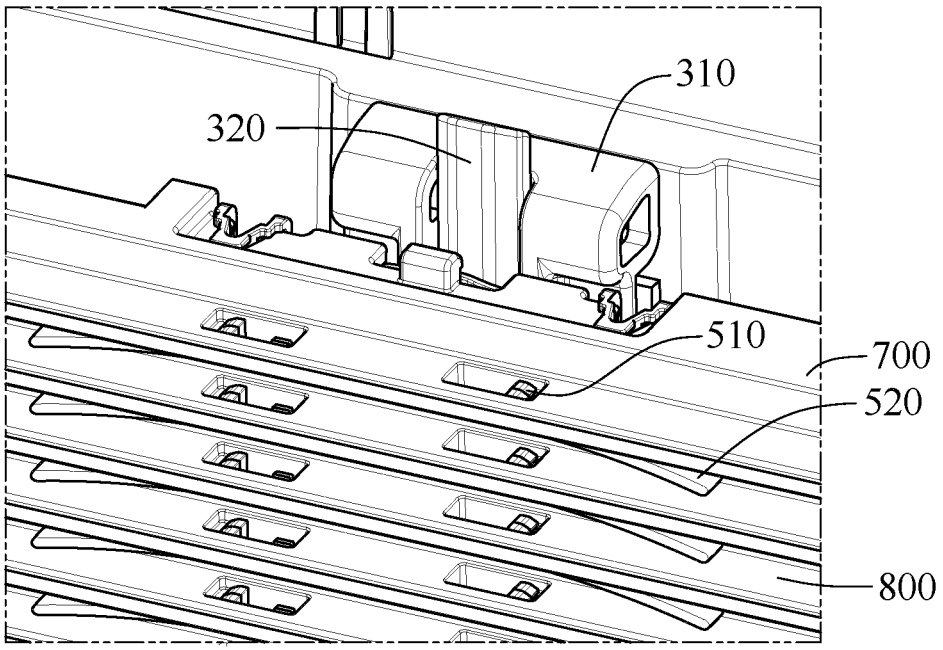
FIG. 6C is a perspective schematic diagram of an elastic support element from another perspective according to an embodiment of the present disclosure.

Refer to FIG. 6A to FIG. 6C. FIG. 6A shows a schematic diagram of an assembly means of an elastic support element 500 according to an embodiment of the present disclosure. FIG. 6B shows a perspective schematic diagram of the elastic support element 500 according to an embodiment of the present disclosure. FIG. 6C shows a perspective schematic diagram of the elastic support element 500 from another perspective according to an embodiment of the present disclosure.

The holding device further includes the elastic support element 500 disposed at a bottom section of the substrate 700, for example, at a bottom of an edge of the substrate 700. The elastic support element 500 is for elastically pressing against a semiconductor workpiece 800 carried on the substrate 700, for example, for elastically pressing against an edge surface of the semiconductor workpiece 800 carried by the adjacent substrate 700 at a plane near the edge of the substrate 700. The elastic support element 500 elastically presses against and suppresses the semiconductor workpiece 800 carried by the adjacent substrate 700 below, so as to prevent displacement of the semiconductor workpiece 800. The uppermost substrate 700 may not carry any semiconductor workpiece 800, and the semiconductor workpiece 800 carried by the adjacent substrate 700 can be sufficiently suppressed and fixed by the elastic supporting of the elastic support element 500. Thus, when the substrates 700 are placed and stacked in layers, the semiconductor workpiece 800 carried by the substrates 700 can be pressed against and fixed by the elastic support element 500, hence reducing or even preventing displacement, vibration, and friction between the substrates 700 or the semiconductor workpieces 800.

The elastic support element 500 includes a fixed end 510 and an elastic support arm 520. The fixed end 510 is detachably disposed at the bottom section of the edge of the substrate 700, one end of the elastic support arm 520 is connected to the fixed end 510, and the other end of the elastic support arm 520 elastically presses against the edge surface of the semiconductor workpiece 800. The elastic support arm 520 extends from the fixed end 510 toward both ends and elastically presses against the edge surface of the semiconductor workpiece 800. Thus, such horizontal point contact is capable of securely pressing against the substrate 700 and reducing a friction area at the same time.

Figure 7A:
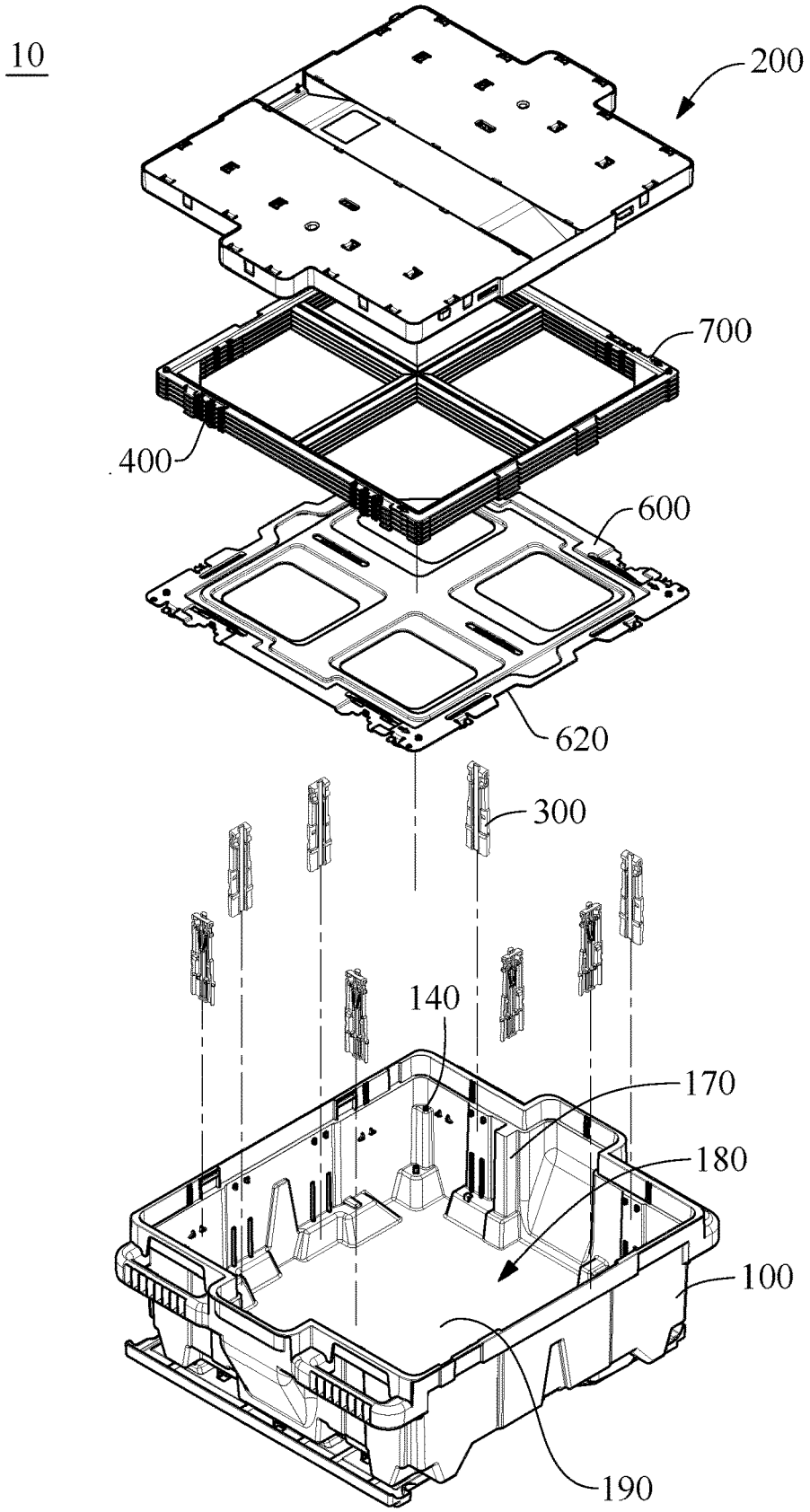
FIG. 7A is an exploded schematic diagram of a top-opening substrate container according to an embodiment of the present disclosure.
Figure 7B:
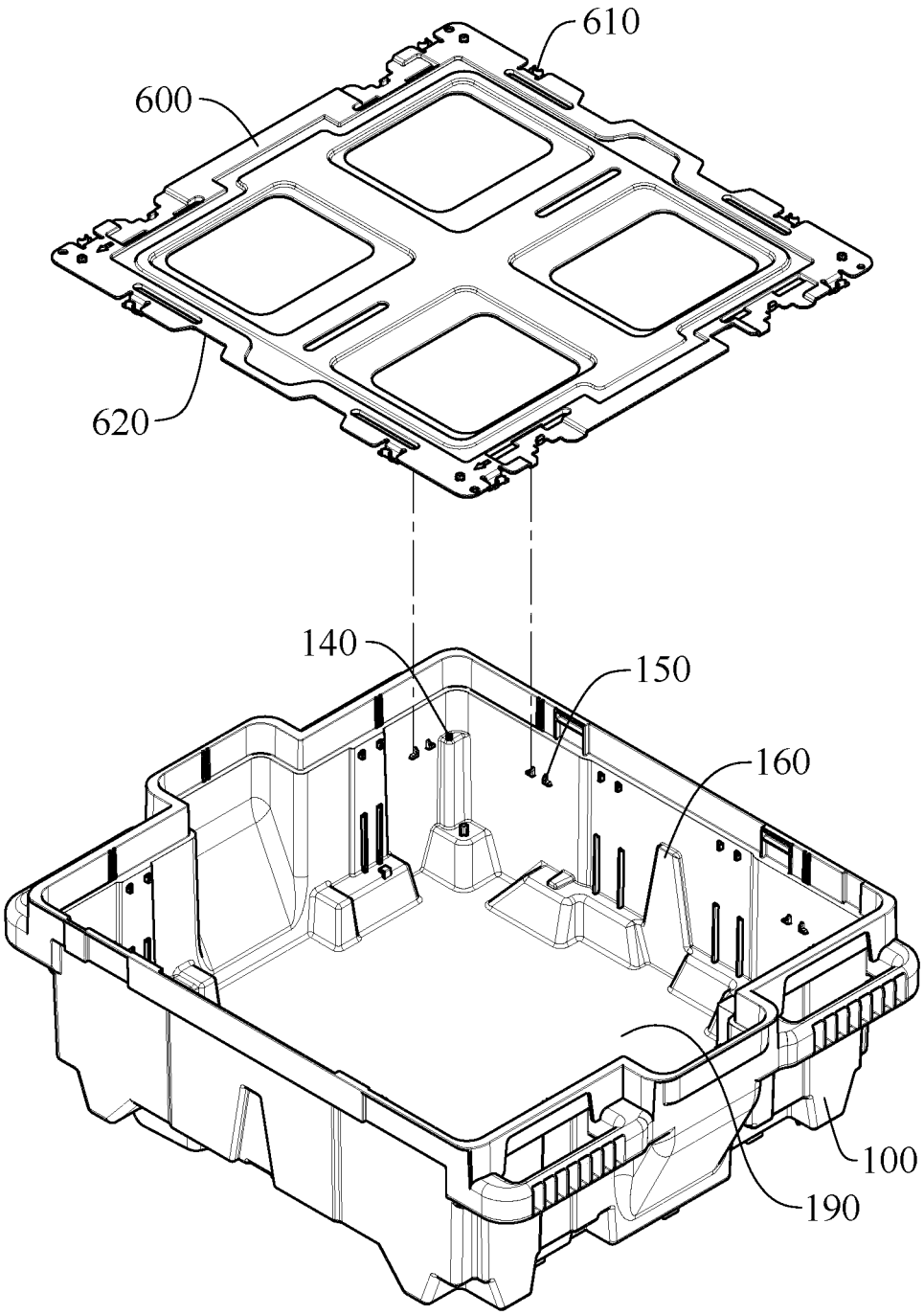
FIG. 7B is an installation schematic diagram of a frame body according to an embodiment of the present disclosure.
Figure 8A:
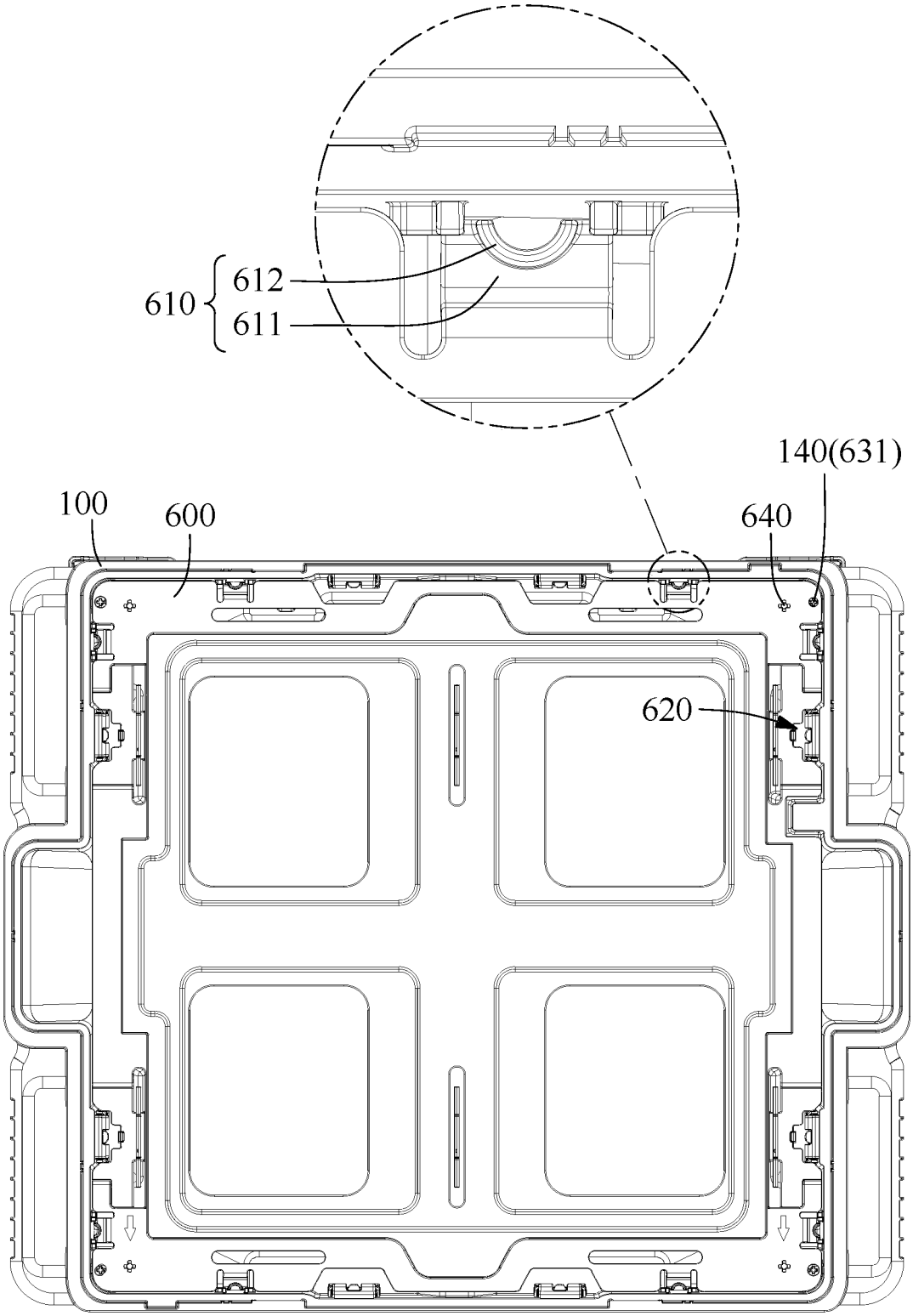
FIG. 8A is a plan schematic diagram of a frame body and a quick release component according to an embodiment of the present disclosure.
Figure 8B:
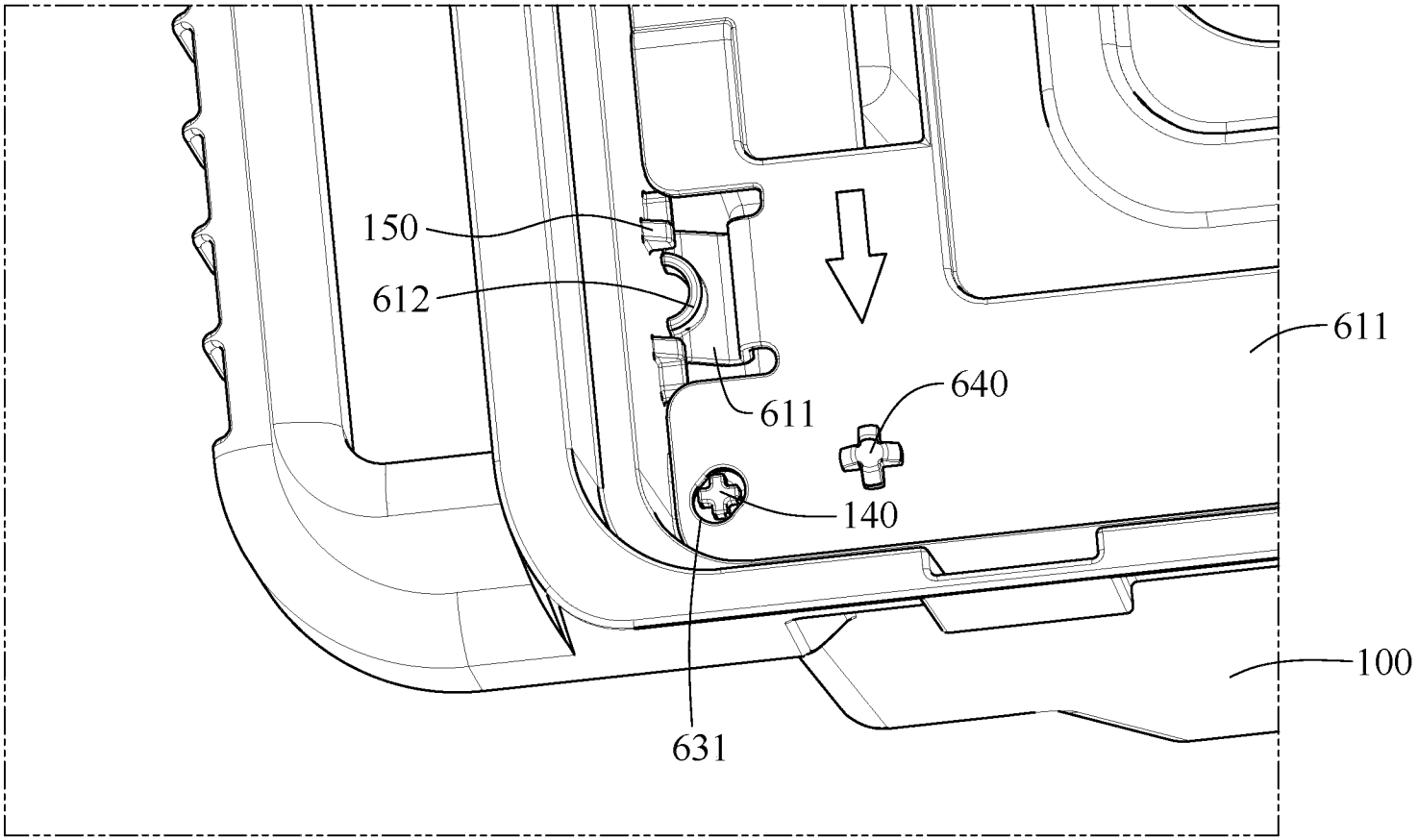
FIG. 8B is an enlarged partial schematic diagram of a frame body according to an embodiment of the present disclosure.
Figure 8C:
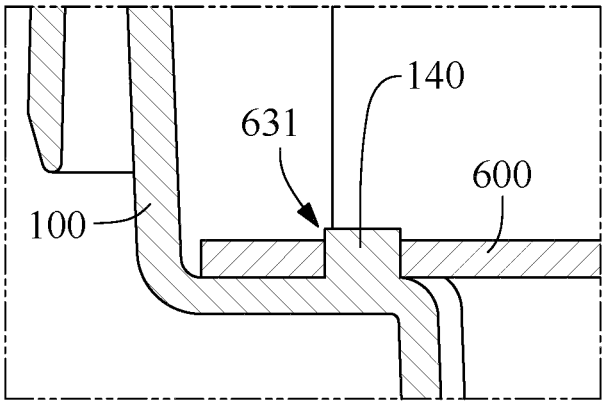
FIG. 8C is a section schematic diagram of a frame body according to an embodiment of the present disclosure.
Figure 8D:
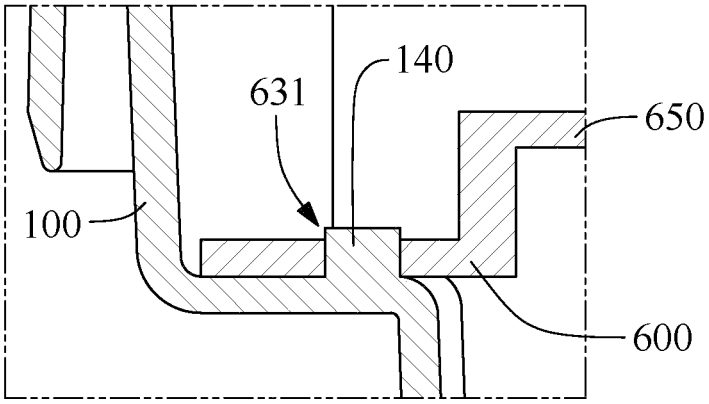
FIG. 8D is a section schematic diagram of a variation of a frame body according to an embodiment of the present disclosure.
Figure 8E:
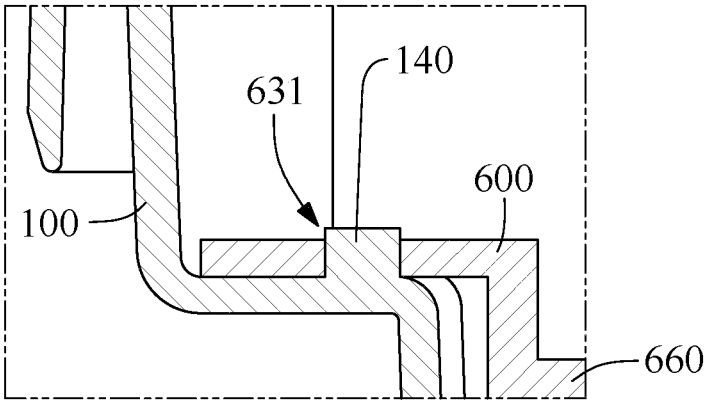
FIG. 8E is a section schematic diagram of another variation of a frame body according to an embodiment of the present disclosure.

Structural design and operation details of the holding device capable of adjusting different numbers of substrates carried of the present disclosure are to be described next. Refer to FIG. 7A to FIG. 8E. FIG. 7A shows an exploded schematic diagram of a top-opening substrate container according to an embodiment of the present disclosure. FIG. 7B shows an installation schematic diagram of a frame body according to an embodiment of the present disclosure. FIG. 8A shows a plan schematic diagram of a frame body and a quick release component according to an embodiment of the present disclosure. FIG. 8B shows an enlarged partial schematic diagram of a frame body according to an embodiment of the present disclosure.

The holding device of the present disclosure is adapted to the top-opening substrate container 10. The same structures, the same functions, and the same element numerals of the top-opening substrate container 10, the substrate actuator 400 and the holding assembly 300 used in the present disclosure are to be omitted herein, and only differences are described. In this embodiment, only the holding device in a novel structure of the present disclosure for solving the issues of the lack of application flexibilities due to the carrying weight and the carry number of the monofunctional top-opening substrate container 10 in one single size is described. More specifically, when the number of substrates 700 carried is less than a predetermined carrying number of the container, a space between the top of the container body 100 and the container opening lack a filler, such that the substrates 700 cannot be effectively pressed against and easily leads to issues of damage caused by wavering, vibration, and hopping. The holding device of this embodiment is also aimed to achieve an effect of solving such issues that the container body 100 can usually carry an exact predetermined number of substrates 700 instead of being able to carry a greater or smaller number of substrates 700.

The structural design details of the holding device are first described. The holding device includes a frame body 600, a plurality of quick release components 610, and a plurality of displacement sections 620. The frame body 600 is disposed in the receiving space 180 and for carrying the substrates 700. The frame body 600 includes a frame positioning component 631, and the container body 100 includes a support element 140. The support element 140 is accommodated in the receiving space 180, and can be designed to have different heights, so as to serve as a bottom positioning component for the frame body 600 in response to an installation position of the frame body 600. Accordingly, the frame body 600 is elevated to be distance by a height from the bottom 190 of the inner surface of the receiving space 180. A frame positioning component 631 and the support element 140 are fixed in coordination to provide weight support and limiting functions. The support element 140 can be a protruding structure and is not defined with specific shape or structural designs, so as to fit fasten at the frame positioning component 631 to further limit the frame body 600. The container body 100 includes an auxiliary support element 160 so as to coordinate with the frame body 600 to provide weight support and/or limiting.

The plurality of quick release components 610 are individually disposed at an outer side part of the frame body 600, for example, on the edges, and each of the quick release components 610 includes a resting element 611 and an opposing shoulder 612. The opposing shoulder 612 is connected to both sides of the resting element 611. The inner wall of the container body 100 is further provided with a plurality of fastening components 150 supported at the opposing shoulders 612 so as to fix the frame body 600. The plurality of displacement sections 620 a provide yield space for the holding assembly 300 disposed in the receiving space 180, so that the original structural features or structure details in the container body 100 do not need to be adjusted in response to the frame body 600.

The inner wall of the container body 100 is provided with the anti-misalignment component 170 for limiting a direction of the frame body 600 accommodated in the receiving space 180. The anti-misalignment component 170 is, for example, a protruding column structure to correspond to a recessed structure of edges of the frame body 600, so that the frame body 600 can be placed in correct orientation into the container body 100.

Each quick release component 610 is provided on the edge of the frame body 600 and has displacement section characteristics. Each quick release component 610 is connected to the frame body 600, and bends downward to form an elastic support hook with an end hooking upward. An end of the support hook can have a plane so as to increase a supporting area with respect to the container body 100. The opposing shoulder 612 is located at an end of the resting element 611, and features both ends protruding compared the plane of the support hook, so as to be limited in the fastening component 150 of the container body 100. When the resting element 611 receives a force and leaves the inner wall by a distance, the opposing shoulder 612 departs from the fastening component 150 such that the frame body 600 becomes a detachable state.

The opposing shoulder 612 can be an annular structure or a semi-annular structure to provide a fit fastening limiting structure with deformation and buffering, and to allow a related tool for releasing the engagement and fixing to apply a force for departing from the fastening component 150. The resting element 611 can be adjusted to have a higher hardness by means of a structure or material, so as to prevent the frame body 600 from being easily removed by a manual operation error that may lead to incorrect number and type of carried substrates 700 in subsequent manufacturing processes. It should be noted that, this embodiment does not limit the structures or forms of the quick release components 610 and the fastening components 150, and any structures capable of engaging and fixing the frame body 600 in the container body 100 are to be encompassed within the scope of protection of the present disclosure.

The frame body 600 disposed in the receiving space 180 has different installation methods. For example, the frame body 600 includes a protruding bearing surface 650 for carrying the substrates 700, so as to further raise a carrying plane carrying the substrates 700; that is, a height of the frame body 600 from the bottom 190 of the inner surface of the receiving space 180 is increased. Accordingly, the number of carried substrates 700 is reduced, so that the carried substrates 700 can get closer to the direction of the container door structure 200.

In an embodiment, the frame body 600 includes a concave bearing surface 660 for carrying the substrates 700, so as to further lower a carrying plane carrying the substrates 700; that is, a height of the frame body 600 from the bottom 190 of the inner surface of the receiving space 180 is decreased. Accordingly, the number of carried substrates 700 is increased, so that the number of substrates 700 that can be carried can be increased. Thus, with the variations of the protruding bearing surface 650 and the concave bearing surface 660 of the frame body 600, the frame body 600 is enabled to be more freely applied with greater flexibilities to the substrates 700 in different types, sizes, and thicknesses, hence greatly expanding universality of the top-opening substrate container 10.

By using the frame body 600 of the holding device provided according to an embodiment of the present disclosure, when a smaller number of substrates 700 are carried, the substrates 700 are allowed to be closer to the container opening to increase the overall center of gravity, so as to achieve an effect of safety and stability of the substrates 700 that then are not easily wavered in the frame body 600. In addition, an effect of efficiently applying the container body 100 in one single size to carrying the substrates 700 in different types, sizes and thicknesses is also achieved.

The frame body 600 includes a stacking alignment section 640 for engaging and fixing the substrates 700 which are for carrying the semiconductor workpieces 800. As described above, the substrate 700 has the stacking fixed section 710 on the upper and lower surfaces thereof. The stacking alignment section 640 is adapted to the structural or functional characteristics of the stacking fixed section 710, so as to fix and limit the substrate 700 at the frame body 600. The structural characteristics of the frame body 60 are arranged at both front and back surfaces of the frame body 600, so as to enable the frame body 600 to enter at any surface and be fixed at the container body 100 and maintain the structural functions thereof, thereby significantly enhancing the ease of use.

Once the carried substrates 700 are raised, in addition to solving the issue of being prone to wavering when the container body 100 carries only a smaller number of substrates 700, the frame body 600 of the present disclosure can further increase the overall center of gravity, so that the top-opening substrate container 10 can still be safety and efficiently transported and carried even when the substrates 700 are extremely heavy. Moreover, the frame body 600 of the present disclosure also solves the issue that, in order to have the top-opening substrate container 10 satisfy designs of different types, sizes, thicknesses, and density specifications, a new mold for the top-opening substrate container 10 that satisfies different types and specifications of the substrates 700 needs to be additionally provided. With the frame body 600 provided by the present disclosure, only the frame body 600 needs to be re-designed, and the monofunctional top-opening substrate container 10 in one single size can then be applied to different types, sizes, thickness, and density specifications of substrates 700, thereby achieving effects of significantly reducing production costs and enhancing utilization efficiency.

Figure 9:
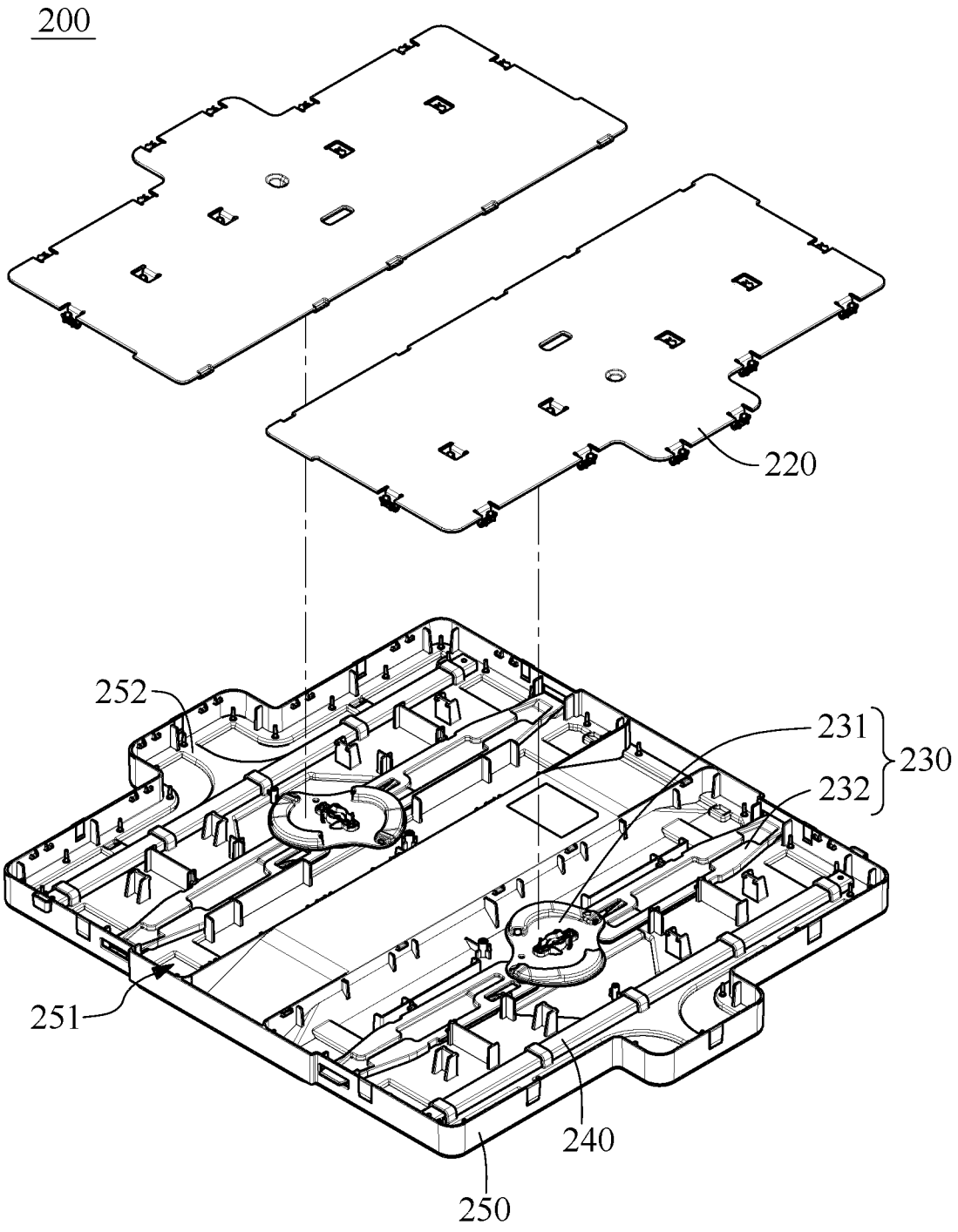
FIG. 9 is an exploded schematic diagram of a container door structure according to an embodiment of the present disclosure.

FIG. 9 shows an exploded schematic diagram of a container door structure adapted for a holding device according to an embodiment of the present disclosure. The holding device of the present disclosure is adapted to the top-opening substrate container 10. The same structures, the same functions, and the same element numerals of the top-opening substrate container 10, the substrate actuator 400 and the holding assembly 300 used in the present disclosure are to be omitted herein, and only differences are described. In this embodiment, only the holding device in a novel structure of the present disclosure is described, so as to achieve the function of maintaining airtightness by the container door structure 200 under a condition of the top-opening substrate container 10 carrying a large weight.

The holding device of the present disclosure includes at least one leveling component 240. The container door structure 200 includes a door shell 250 and a door panel 220. The door panel 220 is for combining with the door shell 250 so as to define a receiving space 251 which is for accommodating a latch mechanism 230. The leveling component 240 is disposed in the receiving space 251, and extends globally to press against two opposite inner walls of the door shell 250. Moreover, the leveling component 240 and the latch mechanism 230 are arranged in parallel. The leveling component 240 is a carbon rod, of which an overall height is less than a total depth of the receiving space 251. The leveling component 240 can also be an element formed of an extensible material having a high rigidity and a light weight.

The leveling component 240 is for providing structural support and force transmission sharing for the door shell 250 by means extending by an extension length between the two opposite inner walls pressing against the door shell 250, further providing the door shell 250 with effects of structural reinforcement and a uniform received force. The leveling component 240 is disposed adjacent to a transportation position of the container door structure 200, as ear sections 252 on two ends shown in FIG. 9.

Thus, with the leveling component 240 provided in the container door structure 200 of the holding device, the leveling component 240 is able to share by means of the extension length of the leveling component 240, a large force that force concentration points of the container door structure 200 impose during the transportation process upon a lock position of the latch mechanism 230 and the container body 100 and two side ear sections to the door shell 250, further solving the issue of a restricted carrying weight of the top-opening substrate container 10. Meanwhile, the issues of undesirably affected airtightness and even falling off and damage caused by deformation and separation of the container door structure 200, as a result of distortion and deformation of the container door structure 200 of the top-opening substrate container 10 during complicated carrying and transportation processes when the carrying weight reaches an upper limited, are also solved.

Moreover, because an element weight of the leveling component 240 is much lighter than a weight of the latch mechanism 230, the issue of multiple latch mechanisms 230 distributed at various locations of the container door structure 200 for securing and locking is also solved for the top-opening substrate container 10. During movement of the top-opening substrate container 10, although the approach above using the multiple latch mechanisms 230 is capable of dispersing a load to be lifted so as to improve the issue of deformation of a door, the plurality of latch mechanisms 230 need to be used, in a way that not only the top-opening substrate container 10 then has an increased weight, a more complicated assembly and increased manufacturing costs, but also designs of the container door structure 200 and the multiple latch mechanisms 230 in order to disperse the load are made challenging. Thus, provided that the latch mechanisms 230 are kept in a small number, the effect of solving the issue of deformation of the container door structure 200 is achieved by using the leveling component 240, and airtightness of the door is also reinforced under a condition of keeping an element light-weight.

In an embodiment of the present disclosure, the latch mechanism 230 can also be multiple in number, so as to provide a larger number of lock positions or to coordinate with different structures; for example, two latch mechanisms 230 are provided to effectively achieve balance in locking and weight distribution.

In an embodiment of the present disclosure, the leveling component 240 is multiple in number, so as to provide the door shell 250 with structural support and force dispersion at different positions and different force receiving hot spots. The plurality of leveling components 240 are, for example, two, which are respectively fixed at both sides in the door shell 250, so as to provide edges of the door shell 250 with uniform force dispersion, and to reinforce structural support and received force dispersion for ear sections 252 of the door shell 250.

In an embodiment of the present disclosure, the extension length of the leveling component 240 extends from one end of the door shell 250 to the other end of the door shell 250 and presses against two opposite inner walls of the container door structure 200, so as to completely disperse the force received at the length of the entire door shell 250 and to provide the length of the entire door shell 250 with structural support.

In an embodiment of the present disclosure, the leveling component 240 and the latch mechanism 230 are arranged in parallel, so as to provide a lock position near the latch mechanism 230 with force dispersion and structural support. With the leveling component 240 and the latch mechanism 230 arranged in parallel, the forces received at the force receiving points and the lock force receiving point of the latch mechanism 230 can be uniformly dispersed nearby, and at the same time facilitate a space distribution design of the door shell 250. The leveling component 240 and the latch mechanism 230 are in a symmetrical arrangement, such that the support structure and force dispersion can be symmetrical to prevent deviation or deformation of the container door structure 200.

In an embodiment of the present disclosure, the latch mechanism 230 includes a control element 231 and a latch arm 232. The control element 231 controls the latch arm 232 to selectively extend out of the door shell 250 so as to control the container door structure 200 to be locked at the container body 100, or controls the latch arm 232 to withdraw so as to release locking between the container door structure 200 and the container body 100. The control element 232 is, for example, a cam, and the latch arm 232 connected to the cam is driven to extend or withdraw by means of rotating the cam. With the leveling component 240 and the latch mechanism 230 arranged in parallel, force dispersion, and structural support are provided near a lock position of the latch arm 232 and the container door structure 200, the forces received at the force receiving points of the ear sections 252 and the lock force receiving point of the latch mechanism 230 can be uniformly dispersed nearby, and at the same time a space distribution design of the door shell 250 is facilitated, so as to alleviate overlapping between the leveling component 240 and the latch arm 232, thereby maintaining the extension length of the leveling component 240 and effectively achieving structural support and force dispersion. It should be noted that, the numbers and positions of the leveling component 240 and the latch mechanism 230 are not limited to the examples given in this embodiment.

With the leveling component 240 provided according to an embodiment of the present disclosure, the overall load of the container door structure 200 is dispersed through the leveling component 240, hence reinforcing the levelness of the door shell 250 so as to prevent a gap from appearing in an airtight adhesive strip between the container door structure 200 and the container body 100, and at the same time enhance the strength of the container door structure 200 so as to achieve the objects of levelness and airtightness. In addition, the leveling component 240 can be used in substitution for a partial number of the latch mechanism 230 to minimize the number of the latch mechanism 230, thereby alleviating the weight of the overall container door structure 200 as well as reducing part consumption and lowering production and manufacturing costs.

Thus, with the hold device of the present disclosure, in addition to tightly and securing fixing the substrates carried in the top-opening substrate container to prevent wavering and collision of the substrates, the stability of different numbers of substrates carried can be maintained to prevent hazards and dangers caused by the wavering and an overly low center of gravity, and the structural strength and airtightness of the container door structure can be maintained to protect cleanliness and reduce the risks of falling of the substrates therein, further achieving effects of protecting the transported substrate container.

The present invention is described by way of the preferred embodiments above. A person skilled in the art should understand that, these embodiments are merely for describing the present invention are not to be construed as limitations to the scope of the present invention. It should be noted that all equivalent changes, replacements and substitutions made to the embodiments are to be encompassed within the scope of the present invention. Therefore, the protection of the present invention should be accorded with the broadest interpretation of the appended claims, so as to encompass all modifications and similar arrangements and processes.

What is claimed is:

1. A holding device for a top-opening substrate container, the top-opening substrate container comprising a container body and a container door structure, the container door structure configured to be combined with the container body so as to define a receiving space for accommodating a plurality of substrates; the holding device comprising:

a substrate actuator, disposed at an outer side part of the substrates; and a holding assembly, disposed in the receiving space, the holding assembly for pushing the substrate actuator to operate, the holding assembly comprising:

a holding body, disposed at an inner side part of the container body; and a pushing actuator, disposed at the holding body, the pushing actuator comprising:

a first guiding sloped surface, for pressing against a second guiding sloped surface of an inner surface of the container door structure, the first guiding sloped surface causing corresponding pushing and displacement between the first guiding sloped surface and the second guiding sloped surface according to a supporting force of the container door structure; and a pushing section connected to the first guiding sloped surface, the pushing section corresponding to a position of the substrate actuator and correspondingly pushing the substrate actuator to operate according to a level of the pushing and displacement of the first guiding sloped surface, such that the substrate actuator displaces the substrate until the plurality of substrates are stacked and positioned with one another.

2. The holding device according to claim 1, wherein the holding body comprises an inclined guide channel, the pushing actuator comprises a guiding section connected to the pushing section, and the guiding section protrudes in the inclined guide channel and displaces correspondingly in the inclined guide channel according to the supporting force of the container door structure, such that the pushing actuator comes close to the holding body or gets away from the holding body.

3. The holding device according to claim 2, wherein the holding assembly further comprises:

an elastic element disposed between the holding body and the pushing actuator, the elastic element configured to provide, according to the supporting force of the container door structure, an elastic variation for the guiding section to displace in a direction away from the holding body along the inclined guide channel, or for the guiding section to displace in a direction close to the holding body along the inclined guide channel.

4. The holding device according to claim 1, wherein the substrate actuator comprises:

a connection section, fixedly connected to the outer side part of the substrate;

an elastic deformation section, connected to the connection section, the elastic deformation section corresponding to a position of the pushing section and providing a displacement amount for elastic deformation and pushing the substrate according to a level of pushing and displacement of the pushing section; and a first fixed section, disposed at one lateral part of the elastic deformation section, the first fixed section for fixing a second fixed section of an adjacent substrate.

5. The holding device according to claim 1, wherein a bottom of the inner surface of the container body further comprises a bottom positioning component, each of the substrates comprises a substrate position member corresponding to the bottom positioning component, and the bottom positioning component is for positioning the substrate located closest to the bottom of the inner surface in the receiving space.

6. The holding device according to claim 1, wherein a bottom of the inner surface of the container body further comprises a bottom snap component for engaging and fixing between the substrate closest to the bottom of the inner surface in the receiving space and the substrate actuator disposed thereon.

7. The holding device according to claim 1, wherein each of upper and lower surfaces of each of the substrates is provided with an adapted stacking fixed section, and adjacent substrates are stacked in layers with one another by the stacking fixed sections.

8. The holding device according to claim 1, further comprising:

at least one elastic support element, disposed at a bottom section of each of the substrates, for elastically pressing against a semiconductor workpiece carried on the substrate.

9. The holding device according to claim 8, wherein the elastic support element comprises a fixed end and an elastic support arm, the fixed end is detachably disposed at the bottom section of each of the substrates, one end of the elastic support arm is connected to the fixed end, and one other end of the elastic support arm elastically presses against an edge surface of the semiconductor workpiece.

10. The holding device according to claim 1, wherein an inner wall of the container body is provided with an anti-misalignment component for restricting a direction of the substrates accommodated in the receiving space.

11. A holding device for a top-opening substrate container, the top-opening substrate container comprising a container body and a container door structure, the container door structure configured to be combined with the container body so as to define an receiving space for accommodating a plurality of substrates; the holding device comprising:

a frame body, disposed in the receiving space, for carrying the substrates;

a plurality of quick release components, individually disposed at an outer side part of the frame body, each of the quick release components comprising a resting element and an opposing shoulder, the opposing shoulder connected to both sides of the resting element, wherein an inner wall of the container body is further provided with a plurality of fastening components, the resting element is abutted against the inner wall, and each of the fastening components is supported at the opposing shoulder so as to fix the frame body; and a plurality of displacement sections, providing a yield space for a holding assembly disposed in the receiving space.

12. The holding device according to claim 11, wherein when the resting element receives a force and leaves the inner wall by a distance, the opposing shoulder departs from the fastening component such that the frame body becomes a detachable state.

13. The holding device according to claim 11, wherein a bottom of an inner surface of the container body further comprises a bottom positioning component, the frame body comprises a frame positioning component corresponding to the bottom positioning component, and the bottom positioning component is for positioning the frame positioning component, so as to define a height distance between the frame body and the bottom of the inner surface of the container body, wherein the bottom positioning component and the fastening component are at a same horizontal height.

14. The holding device according to claim 11, wherein an inner wall of the container body is provided with an anti-misalignment component for restricting a direction of the frame body accommodated in the receiving space.

15. A holding device for a top-opening substrate container, the top-opening substrate container comprising a container body and a container door structure, the container door structure configured to be combined with the container body, the container door structure comprising a receiving space and a latch mechanism disposed in the receiving space; the holding device comprising:

at least one leveling component, disposed in the receiving space, the leveling component globally extending and pressing against two opposite inner walls of the container door structure for providing structural support and force transmission sharing for the container door structure, wherein the leveling component and the latch mechanism are arranged in parallel, wherein the leveling component is disposed adjacent to an ear section of the container door structure, and wherein the ear section, which is configured to sustain a carrying weight of the top-opening substrate container, is a transportation position for the container door structure.

16. The holding device according to claim 15, wherein the leveling component is a carbon rod, of which an overall height is less than a total depth of the receiving space.

* * * * *